US007816646B1

(12) United States Patent
Willoughby et al.

(10) Patent No.: US 7,816,646 B1
(45) Date of Patent: Oct. 19, 2010

(54) LASER DESORPTION ION SOURCE

(75) Inventors: Ross C. Willoughby, Pittsburgh, PA (US); Edward W. Sheehan, Pittsburgh, PA (US); Craig M. Whitehouse, Branford, CT (US)

(73) Assignees: Chem-Space Associates, Inc., Pittsburgh, PA (US); PerkinElmer Health Sciences, Inc., Waltham, MA (US)

( * ) Notice: Subject to any disclaimer, the term of this patent is extended or adjusted under 35 U.S.C. 154(b) by 173 days.

(21) Appl. No.: 12/123,669

(22) Filed: May 20, 2008

Related U.S. Application Data

(63) Continuation of application No. 11/500,055, filed on Aug. 7, 2006, now Pat. No. 7,375,319, which is a continuation of application No. 10/862,304, filed on Jun. 7, 2004, now Pat. No. 7,087,898.

(60) Provisional application No. 60/476,576, filed on Jun. 7, 2003.

(51) Int. Cl.
*H01J 49/04* (2006.01)

(52) U.S. Cl. ..... 250/288

(58) Field of Classification Search ..... 250/288
See application file for complete search history.

(56) References Cited

U.S. PATENT DOCUMENTS

| | | | |
|---|---|---|---|
| 4,204,117 | A | 5/1980 | Aberle et al. |
| 4,209,696 | A | 6/1980 | Fite |
| 4,300,004 | A | 11/1981 | Iribane et al. |
| 4,318,028 | A | 3/1982 | Perel et al. |
| 4,468,468 | A | 8/1984 | Benninghoven et al. |

(Continued)

FOREIGN PATENT DOCUMENTS

| | | |
|---|---|---|
| GB | 2348049 | 9/2000 |

(Continued)

OTHER PUBLICATIONS

Supplementary European Search Report dated Oct. 12, 2007 for corresponding European application No. EP04754443.

(Continued)

*Primary Examiner*—Kiet T Nguyen
(74) *Attorney, Agent, or Firm*—Fish & Richardson P.C.

(57) ABSTRACT

Atmospheric pressure, intermediate pressure and vacuum laser desorption ionization methods and ion sources are configured to increase ionization efficiency and the efficiency of transmitting ions to a mass to charge analyzer or ion mobility analyzer. An electric field is applied in the region of a sample target to accumulate ions generated from a local ion source on a solid or liquid phase sample prior to applying a laser desorption pulse. The electric field is changed just prior to or during the desorption laser pulse to promote the desorption of charged species and improve the ionization efficiency of desorbed sample species. After a delay, the electric field may be further changed to optimize focusing and transmission of ions into a mass spectrometer or ion mobility analyzer. Charged species may also be added to the region of the laser desorbed sample plume to promote ion-molecule reactions between the added ions and desorbed neutral sample species, increasing desorbed sample ionization efficiency and/or creating desired product ion species. The cycling of electric field changes is repeated in a timed sequence with one or more desorption laser pulse occurring per electric field change cycle. Embodiments of the invention comprise atmospheric pressure, intermediate pressure and vacuum pressure laser desorption ionization source methods and devices for increasing the analytical flexibility and improving the sensitivity of mass spectrometric analysis.

20 Claims, 21 Drawing Sheets

U.S. PATENT DOCUMENTS

| | | | | |
|---|---|---|---|---|
| 4,531,056 | A | 7/1985 | Labowsky et al. | |
| 4,540,884 | A | 9/1985 | Stafford et al. | |
| 4,542,293 | A | 9/1985 | Fenn et al. | |
| 4,977,320 | A | 12/1990 | Chowdhury et al. | |
| 4,999,492 | A | 3/1991 | Nakagawa | |
| 5,280,175 | A | 1/1994 | Karl | |
| 5,306,910 | A | 4/1994 | Jarrell et al. | |
| 5,412,208 | A | 5/1995 | Covey et al. | |
| 5,436,446 | A | 7/1995 | Jarrell et al. | |
| 5,521,380 | A | 5/1996 | Wells et al. | |
| 5,521,382 | A | 5/1996 | Tanaka et al. | |
| 5,559,326 | A | 9/1996 | Goodley et al. | |
| 5,581,081 | A | 12/1996 | Kato et al. | |
| 5,625,184 | A | 4/1997 | Vestal et al. | |
| 5,640,010 | A | 6/1997 | Twerenbold | |
| 5,663,561 | A | 9/1997 | Franzen et al. | |
| 5,736,740 | A | 4/1998 | Franzen | |
| 5,747,799 | A | 5/1998 | Franzen | |
| 5,750,988 | A | 5/1998 | Apffel et al. | |
| 5,756,994 | A | 5/1998 | Bajic | |
| 5,777,324 | A | 7/1998 | Hillenkamp | |
| 5,838,002 | A | 11/1998 | Sheehan | |
| 5,917,185 | A | 6/1999 | Yeung et al. | |
| 5,965,884 | A | 10/1999 | Laiko et al. | |
| 5,969,350 | A | 10/1999 | Kerley et al. | |
| 5,986,259 | A | 11/1999 | Hirabayashi et al. | |
| 5,994,694 | A | 11/1999 | Frank et al. | |
| 6,040,575 | A | 3/2000 | Whitehouse et al. | |
| 6,060,705 | A | 5/2000 | Whitehouse et al. | |
| 6,107,628 | A | 8/2000 | Smith et al. | |
| 6,124,592 | A | 9/2000 | Spangler | |
| 6,140,639 | A | 10/2000 | Gusey et al. | |
| 6,175,112 | B1 | 1/2001 | Karger et al. | |
| 6,204,500 | B1 | 3/2001 | Whitehouse et al. | |
| 6,207,954 | B1 | 3/2001 | Andrien et al. | |
| 6,239,428 | B1 | 5/2001 | Kunz | |
| 6,278,111 | B1 | 8/2001 | Sheehan et al. | |
| 6,359,275 | B1 | 3/2002 | Bertsch et al. | |
| 6,444,980 | B1 | 9/2002 | Kawato et al. | |
| 6,455,846 | B1 | 9/2002 | Prior et al. | |
| 6,465,779 | B1 | 10/2002 | Moini et al. | |
| 6,486,469 | B1 | 11/2002 | Fischer et al. | |
| 6,504,150 | B1 | 1/2003 | Verentchikov | |
| 6,534,764 | B1 | 3/2003 | Verentchikov et al. | |
| 6,534,765 | B1 | 3/2003 | Robb et al. | |
| 6,583,407 | B1 | 6/2003 | Fisher et al. | |
| 6,583,408 | B2 | 6/2003 | Smith et al. | |
| 6,600,155 | B1 | 7/2003 | Andrien et al. | |
| 6,610,986 | B2 | 8/2003 | Hartley | |
| 6,621,077 | B1 | 9/2003 | Guevremont et al. | |
| 6,683,301 | B2 | 1/2004 | Whitehouse et al. | |
| 6,707,036 | B2 | 3/2004 | Makarov | |
| 6,707,037 | B2 * | 3/2004 | Whitehouse | 250/288 |
| 6,744,041 | B2 | 6/2004 | Sheehan et al. | |
| 6,818,889 | B1 | 11/2004 | Sheehan et al. | |
| 6,914,243 | B2 | 7/2005 | Sheehan et al. | |
| 6,943,347 | B1 | 9/2005 | Willoughby et al. | |
| 7,087,898 | B2 | 8/2006 | Willoughby et al. | |
| 7,569,812 | B1 * | 8/2009 | Karpetsky et al. | 250/282 |
| 2002/0011560 | A1 | 1/2002 | Sheehan et al. | |
| 2002/0175278 | A1 | 11/2002 | Whitehouse | |
| 2002/0185595 | A1 | 12/2002 | Smith et al. | |
| 2003/0034452 | A1 | 2/2003 | Fisher et al. | |
| 2003/0038236 | A1 | 2/2003 | Russ et al. | |
| 2003/0052268 | A1 | 3/2003 | Doroshenko et al. | |
| 2003/0160165 | A1 | 8/2003 | Truche et al. | |
| 2003/0197121 | A1 | 10/2003 | Turecek et al. | |

FOREIGN PATENT DOCUMENTS

| | | |
|---|---|---|
| JP | 04215329 | 8/1992 |
| JP | 10088798 | 4/1998 |
| WO | WO 99/63576 | 12/1999 |
| WO | WO 00/08456 | 2/2000 |
| WO | WO 00/08457 | 2/2000 |
| WO | WO 03/010794 | 2/2003 |
| WO | WO 04/110583 | 12/2004 |

OTHER PUBLICATIONS

International Preliminary Report on Patentability dated Dec. 8, 2005 for corresponding PCT application PCT/US2004/017832.

International Search Report dated Aug. 23, 2005 for corresponding PCT application PCT/US2004/017832.

Alousi et al., "Improved transport of atmospheric pressure ions into a mass spectrometer," the Proceedings of the 50$^{th}$ Annual ASMS Conference on Mass Spectrometry and Allied Topics, Orlando, FL, Jun. 2-6, 2002.

Astorga-Wells, "Microfluidic Electrocapture Technology in Protein and Peptide analysis," Dissertaions from Karolinska Institute, Stockholm, Sweden, 2004.

Bruins, "Mass Spectrometry with ion sources operating at atmospheric pressure," *Mass. Spectrom. Rev.* 10, pp. 53-77 (1991).

Buryakov, et al., "A new method of separation of multi-atomic ions. . . ," *Int. J Mass Spectrom. Ion Processes* 128, pp. 143-148 (1993).

Feng et al., "Single isolated droplets with net charge as a source of ions," J. Am. Soc. Mass Spectrom., 11:393-399, 2000.

Hartley et al., "NBC detection in air and water," *Micro/Nano*, 8, pp. 1, 2, and 8 (Dec. 2003).

Hill et al., "Ion mobility spectrometry," Anal. Chem., 62(23):1201A-1209A (1990).

Johnson et al., "The stretched quadrupole ion trap: Implications for the Matheiu au and qu Parameters and Experimental Mapping of the Stability Diagram," Rapid Commun. Mass Spectrom. 6:760-764 (1992).

Karas, "Laser Desorption Ionization of Proteins with Molecular Masses Exceeding 10 000 Daltons," *Anal. Chem.* 1988, 60:2299-2301.

Kim et al., "Design and implementation of a new electrodynamic ion funnel," Anal. Chem., 72:2247-2255, 2000.

Klesper et al., Intensity increase in ESI MS by means of focusing the spray cloud onto the MS Orifice, The Proceedings of the 50$^{th}$ Annual ASMS Conference on Mass Spectrometry and Allied Topics, Orlando, FL, Jun. 2-6, 2002.

Lee et al., "An EHD source for the mass spectral analysis of peptides," Proceedings of the 36$^{th}$ Annual ASMS Conference on Mass Spectrometry and Allied Topics, San Francisco, CA, Jun. 5-10, 1988.

Lee et al., "Electrohydrodynamic emission mass spectra of peptides," Proceedings of the 37$^{th}$ Annual ASMS Conference on Mass Spectrometry and Allied Topics, Miami Beach, FL, May 21-26, 1989.

Lin et al., "Ion transport by viscous gas flow through capillaries," *J. Am. Soc. Mass Spectrom.* 5, pp. 873-885 (1994).

Mahoney et al., "A theoretical and experimental basis for producing very high mass bimolecular ions by electro-hydrodynamic emission," 22$^{th}$ IEEE Industry Applications Society Annual Meeting, Atlanta, GA, Oc. 18-23, 1987.

Mahoney et al., "Electrohydrodynamic ion source design for mass spectrometry: Ionization, ion optics and desolvation," Proceedings of the 38$^{th}$ Annual ASMS Conference on Mass Spectrometry and Allied Topics, Tucson AZ, Jun. 3-8 (1990).

Olivares, et al., "On-line mass spectrometric detection for capillary zone electrophoresis," *Anal. Chem.* 59, pp. 1230-1232 (1987).

Potjewyd, "Focusing of ions in atmospheric pressure gates using electrostatic fields," Ph.D. Thesis, University of Toronto (1983).

Schneider et all, "An atmospheric pressure ion lens that improves nebulizer assisted electrospray ion sources," *J Am. Soc. Mass Spectrom.* 13, pp. 906-913 (2002).

Schneider et al., "An atmospheric pressure ion lens to improve electrospray ionization at low solution flow-rates," *Rapid Commun. Mass Spectrom.* 15, pp. 2168-2175 (2001).

Smith et al., "Capillary zone electrophoresis-mass spectrometry using an electrospray ionization surface," *Anal. Chem.* 60, pp. 436-441 (1988).

Steel et al., "Understanding the quadrupole mass filter through computer simulation," *J. Chem. Ed*. 75, pp. 1049-1054 (1998).
TiTov, "Detailed Study of the Quadrupole Mass Analyzer Operating Within the First, Second, and Third (Intermediate) Stability Regions. I. Analytical Approach," J. A. Soc. Mass Spectrom., 9:50-69, 1998.
Thomson et al., "Improved collisionally activated dissociation. . .," *J. Am. Soc. Mass Spectrom*. 67(10):1696-1704 (1995).
Thomson et al., "RF-only quadrupole with axial fields," Proceedings of the 44th ASMS Conference on Mass Spectrometry and Allied Topics, May 12-17, 1996, Portland, Oregon.
Wittmer et al., "Electrospray ionization ion mobility spectrometry," Anal. Chem., 66:2348-2355, 1994.

* cited by examiner

LASER DESORPTION ION SOURCE

CROSS-REFERENCE TO RELATED APPLICATIONS

This application is a continuation of U.S. application Ser. No. 11/500,055, filed Aug. 7, 2006 and issuing as U.S. Pat. No. 7,375,319, which is itself a continuation of U.S. application Ser. No. 10/862,304 filed on Jun. 7, 2004 and issued as U.S. Pat. No. 7,087,898 which claims the priority of Provisional Patent Application Ser. No. 60/476,576 filed Jun. 7, 2003. Each of the above-identified related applications are incorporated herein by reference.

FEDERALLY FUNDED RESEARCH

The invention described herein was made with the United States Government support under Grant Number: 1R43 RR143396-1 from the Department of Health and Human Services The U.S. Government may have certain rights to this invention.

REFERENCES CITED

| | | |
|---|---|---|
| 4,204,111 | May 1980 | Aberle et al 250/287 |
| 5,640,010 | June 1997 | Twerenbold |
| 5,663,561 | September 1997 | Franzen et al |
| 5,777,324 | July 1998 | Hillencamp |
| 5,917,185 | June 1999 | Yeung et al. |
| 5,965,884 | October 1999 | Laiko et al. 250/288 |
| 5,969,350 | October 1999 | Kerley et al. |
| 5,994,694 | November 1999 | Frank et al 250/281 |
| 6,040,575 | March 2000 | Whitehouse et al |
| 6,140,639 | October 2000 | Gusev et al. |
| 6,175,112 | January 2001 | Karger et al. |
| 6,444,980 | September 2002 | Kawato et al. 250/288 |
| 2002/0,175,278 | November 2002 | Whitehouse 250/281 |
| 2003/0,052,268 | March 2003 | Doroshenko et al. 250/288 |
| 2003/0,160,165 | August 2003 | Truche et al. 250/288 |
| 6,504,150 | January 2003 | Verentchikov 250/286 |
| 6,107,036 | March 2004 | Makarov 250/ |

FIELD OF INVENTION

This invention relates to the generation of gas-phase ions or charged particles from condensed phase sample (e.g. liquid or solid) using laser desorption ionization and related techniques, primarily for analysis of chemical species with mass spectrometers or ion mobility spectrometers.

BACKGROUND OF THE INVENTION

Laser desorption and ionization have been utilized to ablate and ionize a wide variety of surface samples for analysis with mass spectrometry. Matrix-assisted laser desorption/ionization (MALDI) is a desorption and ionization technique that results in productin of gas-phase ions from condensed-phase analyte molecules (e.g. generally large labilte biomolecules) by unique energy partitioning properties of absorbed light from lasers into target sample components. MALDI samples are generally mixtures of matrix and analyte, whereby the light energy from the laser is absorbed primarily by the matrix, facilitating both ionization and desorption of analyte. The beneficial characteristic of these processes is that very little of the energy is partitioned into the internal energy of the analyte, resulting in intact gas-phase analyte ions. Gas-phase anayte ions are generally analyzed by time-of-flight mass spectrometers; however, any number of gas-phase ion analyzers have been considered and employed for MALDI analysis.

The technique of MALDI developed primarily from research by Karas and Hillenkamp (1) in the late 1980. Vacuum MALDI has developed into a widely used commercial technology for analysis of proteins and other macromolecules.

The present invention relates to the application of MALDI to desorption and ionization in vacuum and at intermediate and higher pressures, including atmospheric pressure. Franzen and Koster (U.S. Pat. No. 5,663,561) first described atmospheric pressure MALDI in reference to their atmospheric pressure desorption/ionization technique by stating, "In contrast to MALDI, at atmospheric pressure, the related molecules of the decomposed matrix material are not needed to ionize the macromolecules. The selection of matrix molecules is solely dependent upon their ability to release the large molecules" Albeit, not explicitly claimed in this patent, the concept of atmospheric pressure MALDI (or AP-MALDI) was clearly first described by Franzen and Koster. Ironically, the Franzen and Koster patent begins by arguing that AP-MALDI is inefficient and that augmenting ionization efficiency with gas phase ion-molecule reactions or desorbed neutral species with gas phase reagent ions at atmospheric pressure would offset some of the transmission losses that would occur by inefficient transport from atmospheric pressure.

Laiko and Burlingame (U.S. Pat. No. 5,965,884) distinguish their AP-MALDI from Franzen and Koster by arguing simplicity and non-destructive matrices. This patent dismisses the key arguments made by Franzen and Koster that AP-MALDI is inefficient. The Laiko patent teaches AP-MALDI with the requirement of close coupling of a sample target to the conductance aperture into vacuum. The lack of efficient atmospheric pressure optics with this device requires precise alignment and positioning of sample and the laser beam relative to the vacuum inlet. In addition, Laiko provides for a sweep gas to assist in transport of the ions from the target surface to the vacuum inlet. The transmission of this device is low. The lack of time-sequenced optics with the laser pulse limit ion extraction and transmission efficiency.

Sheehan and Willoughby (U.S. Pat. No. 6,744,041 B2) describe separation of the ionization process [and sample target posision] from the conductance aperture using atmospheric pressure optics. They describe efficient atmospheric pressure transport and compression optics that allow relative independence of sample location from the position of the vacuum inlet. Components of this invention are included by reference into the present invention.

Sheehan and Willoughby (U.S. Ser. No. 10/449,147) describe further improvement of transmission of MALDI generated ions at atmospheric pressure by laminating high transmission elements and incorporating a "back-well" geometry whereby MALDI samples can be placed facing away from the conductance aperture. This geometry facilitates easier access of the laser beam to the sample targets compared to close-coupled designs. The back-well geometry also provides a simplification of sample insertion and easier access to the ionization chamber. Components of this invention are also included by reference into the present invention.

Willoughby and Sheehan (U.S. No. 60/419,699) also describe improvements in transmission of ions from atmospheric pressure sources [including AP-MALDI]. These improvements are accomplished by precisely controlling the electric field through the entire conductance pathway from atmospheric pressure into vacuum. Components of this invention are included by reference into the present invention. Willoughby and Sheehan (U.S. PPA No. 60/476,582) also teach that conductance arrays and patterned optics can further enhance the transmission of ions from atmospheric pressure sources and improve the transmission of MALDI ions from either intermediate of higher-pressure sources. Components of this invention are included by reference into the present invention.

Whitehouse (US 20020175278) describes the use of a variety of RF multipole devices and DC funnel devices to focus and entrain the flow of ions from atmospheric and intermediate pressure MALDI targets to detection. Components of this invention are included by reference into the present invention.

Truche et al. (U.S. Pat. No. 6,707,039 B1) describe a wide variety of alternatives for close-coupling the sample target to the conductance aperture. This technology places high tolerance on sample position and laser position. In addition, it is envisioned that mirrored reflective surfaces close to the plume of the MALDI target would tend to become contaminated and degraded in their optical performance. In addition, the sampling of ions from an electric field between the target and aperture into the field-free region of the vacuum inlet tube would cause rim losses from field penetration and degrade the transport efficiency. The lack of time-sequenced optics with the laser pulse limit ion extraction and transmission efficiency.

Makarov and Bondarenko (U.S. Pat. No. 6,707,036 B2) teach of a positionally optimized sample target device with a close-coupled conductance opening for atmospheric pressure and intermediate pressure MALDI. This device is still subordinate to alignment of laser, target, and lacks spatial or temporal optics to facilitate efficient ion transmission to the mass analyzer. The lack of time-sequenced optics with the laser pulse limit ion extraction and transmission efficiency. 1. Karas, M.; Hillenkamp, F., Anal. Chem. 1988, 60, 2299 2301.

SUMMARY OF THE INVENTION

Dispersive sources of ions at or near atmospheric pressure; such as, atmospheric pressure discharge ionization, chemical ionization, photoionization, or matraix assisted laser desorption ionization, and electrospray ionization generally have low sampling efficiency through conductance or transmission apertures, where less than 1% [often less than 1 ion in 10,000] of the ion current emanating from the ion source make it into the lower pressure regions of the present commercial interfaces for mass spectrometry.

In accordance with the present invention, associated methods of sample charging, laser desorption and sample ionization are intended to improve the collection efficiency and ionization efficiency of atmospheric pressure, intermediate pressure and vacuum laser desorption ionization.

Two advantages of the current device should be emphasized. First, precisely timing the sequence of laser pulse with ion extraction under high voltage followed by reduction of the electric field in the extraction and focusing region before losing ions to surfaces. The field in the extraction and focusing region is reduced so that the ions are efficiently focused and transmitted through a conductance aperture into a lower pressure region on the path to a mass analyzer. The second important advantage is the ability to populate the sample surface with ions of the sample polarity as the analyte ions to be extracted. This condition drives the equilibrium toward product with an excess of reagent ions compared to conventional MALDI and increases the efficiency of ionization of analyte. One aspect of the current invention is to precharge a sample prior to laser desorption to enhance the yield of ions from a given sample.

Another object of this patent is to incorporate precision precharging of a sample to predetermined spots on a sample (e.g. biopsy of suspected cancer tissue) in order to facilitate enhance yield of ions from a given spot. Optical imaging can be used to determine the precise position of sample precharging and laser pulse impingement (e.g. dye markers or fluorescent tags visualized by microscopes with video recording).

An object of this invention is to use specialized target surfaces with shaped needles or electrodes behind the sample in order to control the electric field experienced by the sample during and after laser pulse. By varying voltage in space and time, optimum sample precharging, ion generation and extraction of ions can be achieved.

The damping of motion of ions at atmospheric pressure make transport in electric fields much slower compared to ion motion in intermediate pressure or vacuum. In addition, the inertial components of motion are substantially damped at higher pressures (above 1 Torr) and the slower ion motion is controlled by moving ions in the direction of optimized local electric fields. Still further objects and advantages will become apparent from a consideration of the ensuing description and drawings.

In accordance with the present invention, atmospheric pressure, intermediate pressure and vacuum laser desorption ion sources comprise ionization chambers and transmission devices encompassing targets for holding samples, lasers to illuminate said targets resulting in desorption and ionization of the samples, time-sequenced electrostatic potentials to foster efficient extraction, focusing, and selecting of resulting gas-phase ions. Laser desorption ion sources in accordance with the invention also comprise a means to accumulate charge on a sample prior to laser desorption of the sample and a means to conduct gas phase ionization of laser desorbed neutral sample molecules to increase the ionization efficiency of a sample during and after a desorption laser pulse.

DETAILED DESCRIPTION OF THE INVENTION AND THE PREFERRED EMBODIMENTS

Figure 1:
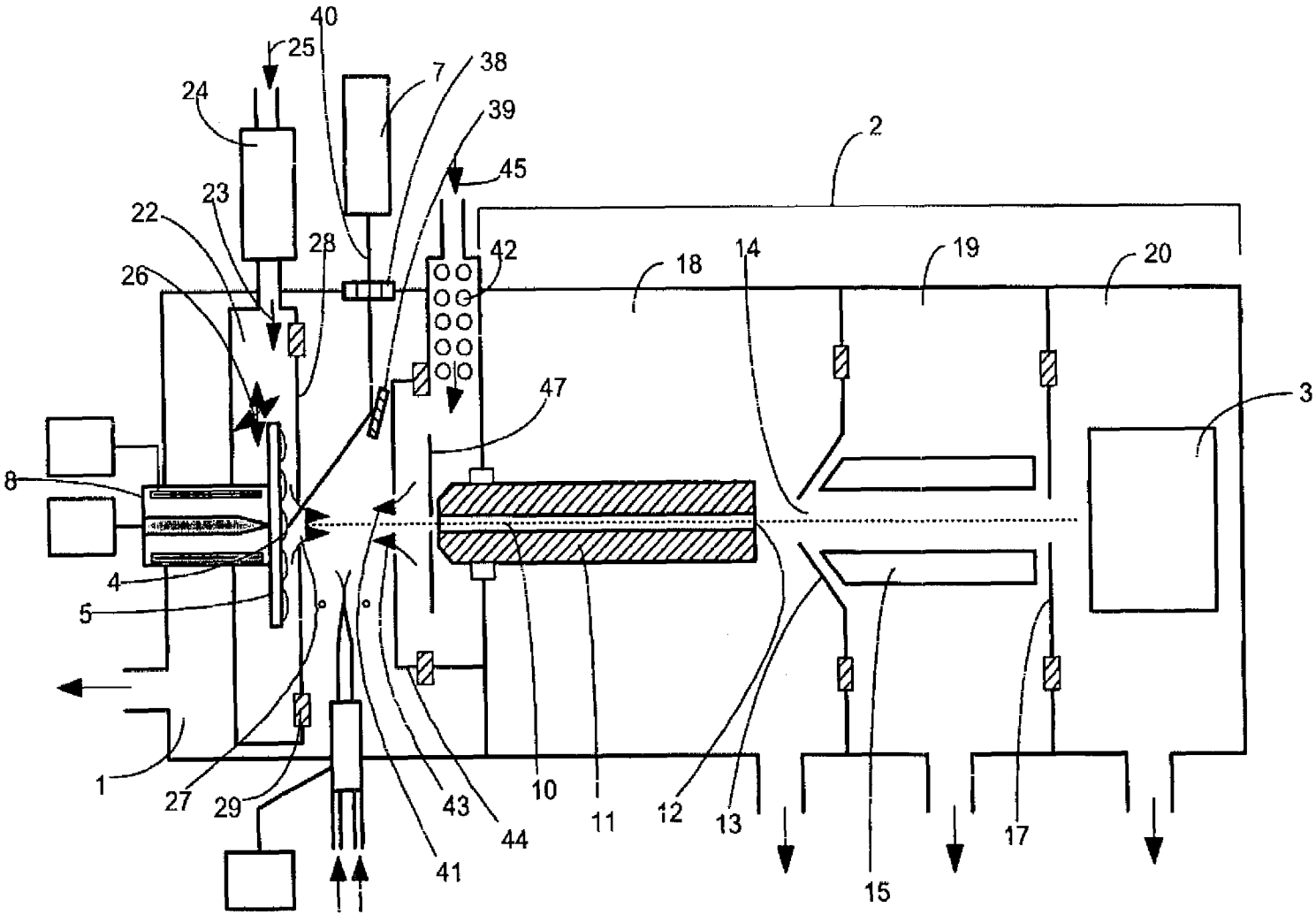
FIG. 1 is a diagram of an atmospheric pressure Laser Desorption Ionization source, incorporating surface charging, interfaced to a mass spectrometer.

A preferred embodiment of the invention comprising an atmospheric pressure Laser Desorption Ionization source with sample surface charging is diagrammed in FIG. 1. Operating details for Laser Desorption Ionization source 1 are diagrammed in FIGS. 2A through 2D. Laser Desorption Ionization (LDI) source 1 interfaced to vacuum system 2 comprising ion transfer optics and mass to charge analyzer with detector 3, produces ions from sample 4 on target plate 5. A portion of the laser desorption ion population produced is focused into bore 10 of capillary 11. Ions exit capillary bore 10 at capillary exit end 12 into vacuum and are accelerated in a free jet expansion of neutral background gas flowing through capillary bore 10 from atmospheric pressure ion source 1. Capillary 11 may comprise a dielectric capillary with conductive electrodes on the entrance and exit faces, a heated electrically conductive capillary, a nozzle, an orifice or an array of orifices into vacuum. Ions pass through skimmer 13 orifice 14 and into ion guide 15 where their translational energies are damped through collisions with background gas. Ions exiting ion guide 15 pass through exit lens 17 and are mass to charge analyzed in mass to charge analyzer and detector 3. Ion guide 15 may comprise a multipole ion guide, a segmented multipole ion guide, a sequential disk RF ion guide, an ion funnel or other ion guides known in the art. Ion guide 15 may extend continuously into one or more vacuum pumping stages or may begin and end in one vacuum stage. Mass analyzer and detector 3 may comprise a quadrupole, triple quadrupole, three dimensional ion trap, linear ion trap, Time-Of-Flight (TOF), magnetic sector, Fourier Transform Ion-Cyclotron Resonance (FTICR), Orbitrap or other mass to charge analyzer known in the art. Vacuum system 2 comprises vacuum stages 18, 19 and 20. Alternatively, embodiments of the invention may comprise vacuum systems with more or less vacuum stages depending on the requirements of the vacuum ion optics and mass to charge analyzer. Atmospheric pressure ion source 1 produces ions from a sample deposited on or part of a surface. As will be described below, the sample may comprise a solid or liquid.

Sample 4 on target plate 5 is positioned in target plate chamber 22 Gas or gas containing ions 23 enters target surface chamber 22 through target gas controller 24. Target gas controller 24 comprises a gas heater and an ion source to generate reagent ions from a gas and/or liquid input 25. Target gas controller 25 may comprise a pneumatic nebulization charge droplet sprayer followed by a vaporizer producing a heated carrier gas containing reagent ions formed from the evaporating charged droplets. Alternatively, target gas controller 25 may comprise a photoionization source, a glow discharge ionizer, a corona discharge ionizer configured in an atmospheric pressure chemical ionization (APCI) source or other type of gas or liquid sample ion source. Depending on the composition of sample 4 and the specific analysis requirements, target gas controller 24 can be configured and operated to deliver unheated neutral gas, heated neutral gas or an ion and gas mixture into target plate chamber 22 during laser desorption ion source operation. Reagent ion containing gas flow 23 passes between target plate 5 and target plate counter electrode 28 exiting target plate chamber 22 at opening 27 in target plate counter electrode lens 28. Electrode 28 is electrically insulated from target plate chamber 22 by insulators 29. As will be described below, reagent ions entrained gas flow 23 may be selectively deposited on sample 4, directed through opening 27 or discharged on target lens 28 during laser desorption ion source operation.

Figure 2A:
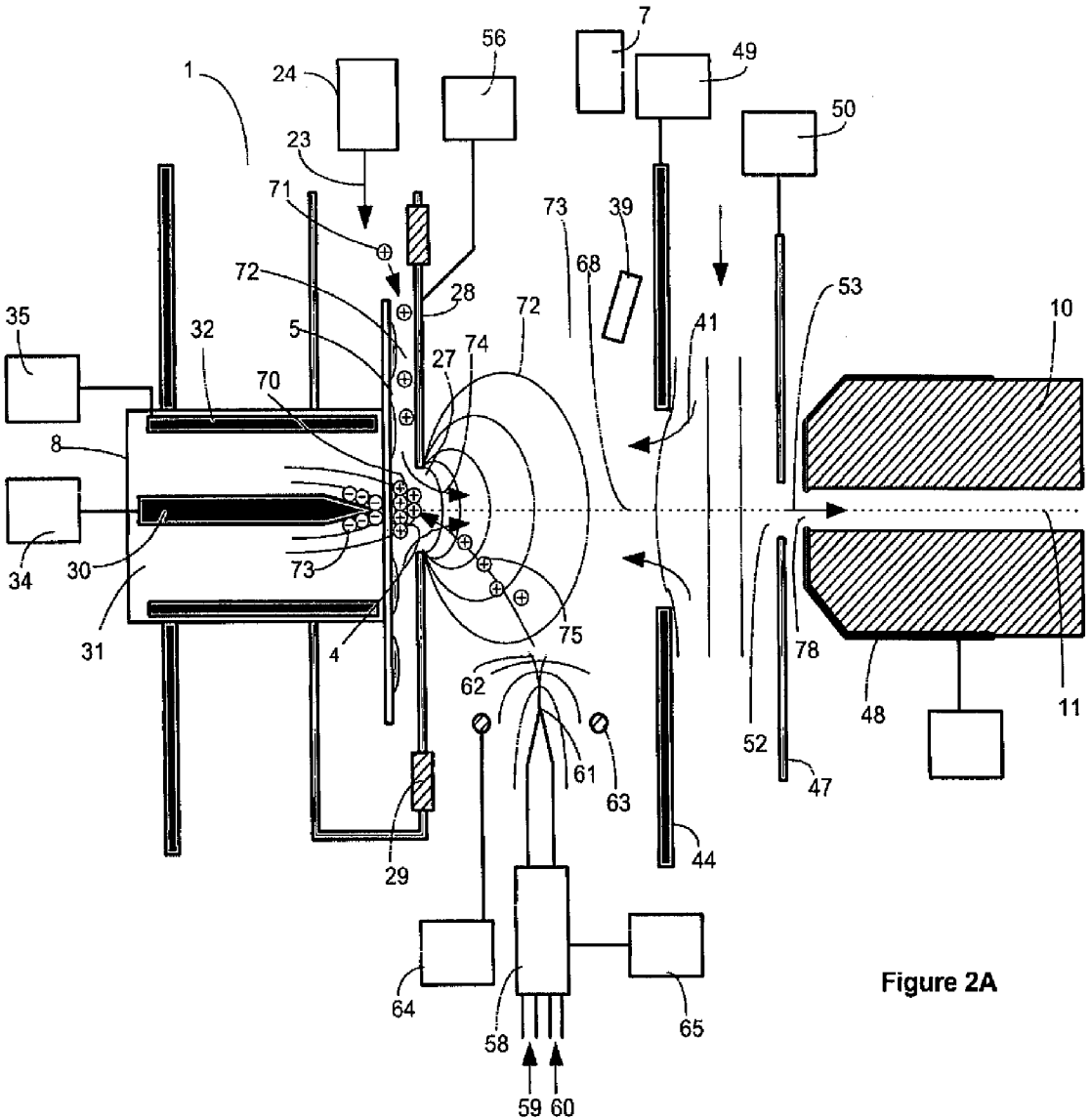
FIG. 2A is a diagram of the atmospheric pressure Laser Desorption Ionization source shown in FIG. 1 during the operating step of charge accumulation on the sample surface.
Figure 2B:
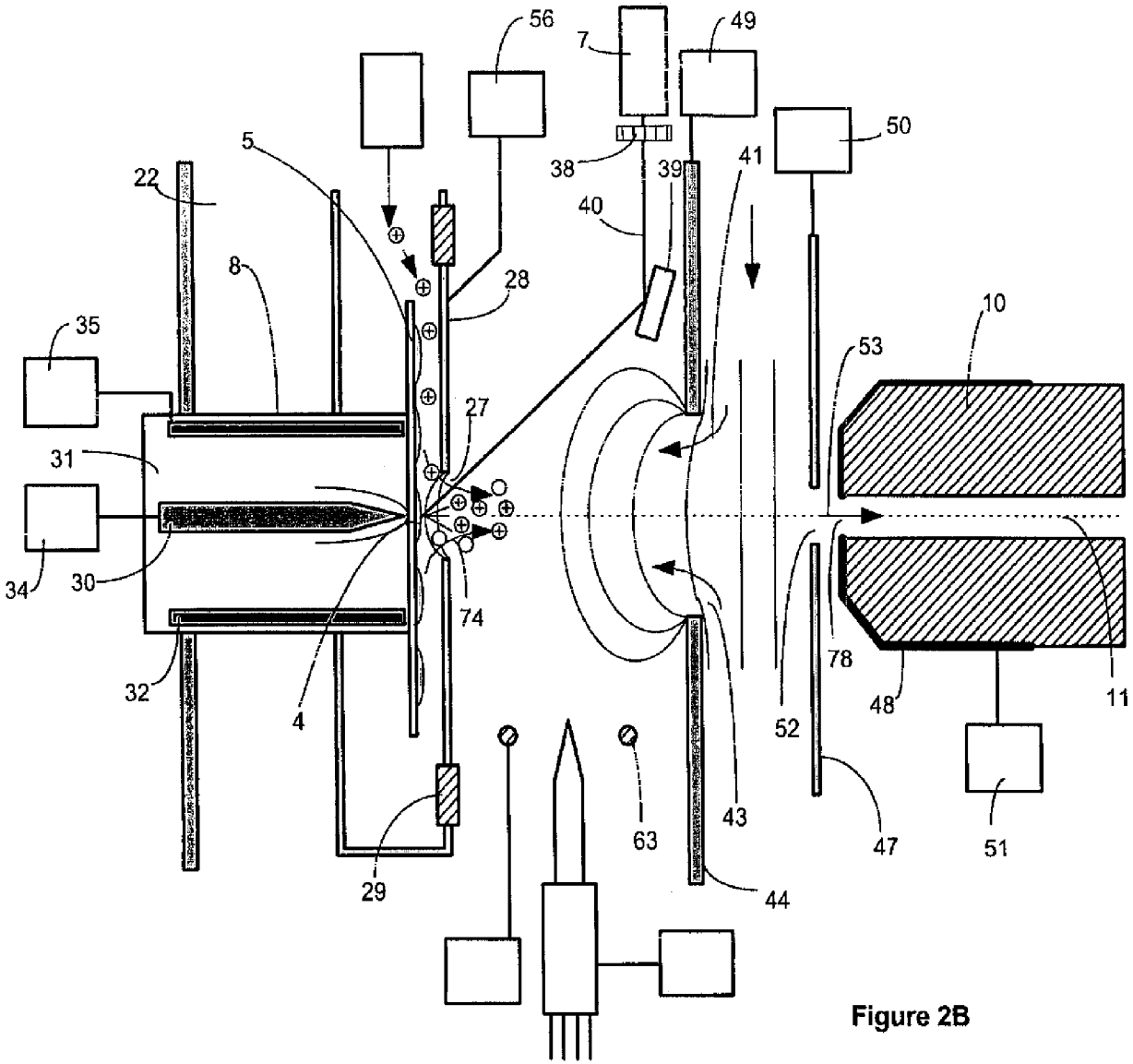
FIG. 2B is a diagram of the atmospheric pressure Laser Desorption Ionization source shown in FIG. 1 during the operating step of laser firing and charge release from the sample.

Target plate 5 can be moved manually or by software control in the x and y directions using x-y translator 26. Charging electrode assembly 8 remains fixed in position while target plate 5 slides over it. A more detailed diagram of charging electrode assembly 8 is shown in FIGS. 2A through 2D and 8B Charging electrode assembly 8 comprises charging electrode 30 and shielding electrode 32 forming an electrically conductive cylinder around charging electrode 30. Charging electrode 30 and shielding electrode 32 are embedded in dielectric block 31 to allow the application of high voltage to charging electrode 30 without the onset of gas phase corona discharge or arcing. Voltages are applied to electrodes 30 and 32 through power supplies 34 and 35 respectively. Laser 7 is configured to deliver laser pulse 40 through lens or window 38 and reflected off mirror 39 to impinge on sample 4 as shown in FIG. 2B. Countercurrent gas 45 passes through gas heater 42 and exits through opening 43 of endplate electrode 44 forming countercurrent gas flow 41 in LDI source 1. Gas 53 and desorbed ions pass through opening 52 in electrode 47 and capillary entrance electrode 48 into capillary 10 bore 11. Voltages applied to electrodes 28, 44, 47 and 48 through power supplies 56, 49, 50 and 51 respectively are set to maximize focusing and ion transmission into capillary bore 11 as will be described below. Charged droplet sprayer 58 comprises liquid inlet 59, nebulization gas inlet 60, sprayer tip 61 and ring electrode 63 as shown in FIG. 2A. Voltages are applied to charged droplet sprayer 58 and ring electrode 63 through power supplies 65 and 64 respectively. In the preferred embodiment shown, charged droplet sprayer 58 is configured to produce a spray of charged droplets oriented orthogonal to ion source centerline 68. Charged droplets are produced through conventional Electrospray or pneumatic nebulization in the presence of an electric field. Heated countercurrent drying gas 41 and target plate gas 74 aid in evaporating the charged droplets in spray 62. In a non laser desorption operating mode, voltages applied to electrodes 30, 28 44, 47 and 48 are set to direct ions generated from evaporating the charged droplets in spray 62 into capillary bore 11. In this Electrospray operating mode, ions produced from sample bearing solution 59 are directed into vacuum and mass to charge analyzed. Ion source 1 can be operated in Electrospray or atmospheric pressure Laser Desorption ionization mode individually or both ionization modes can be run simultaneously. Rapid switching between Electrospray and Laser Desorption ionization can by achieved using the ion source embodiment shown in FIG. 1. In an alternative embodiment of the invention, charged droplet sprayer 58 is replaced by an Atmospheric Pressure Chemical Ionization source comprising a pneumatic nebulizer, vaporizer and corona discharge needle. Alternatively, a glow discharge, photoionization or other type of ion source can be configured to produce ion species in region 73 between electrodes 28 and 44. Alternatively LDI source 1 can be configured with multiple ion generation sources delivering ions individually or simultaneously into region 73.

Figure 2C:
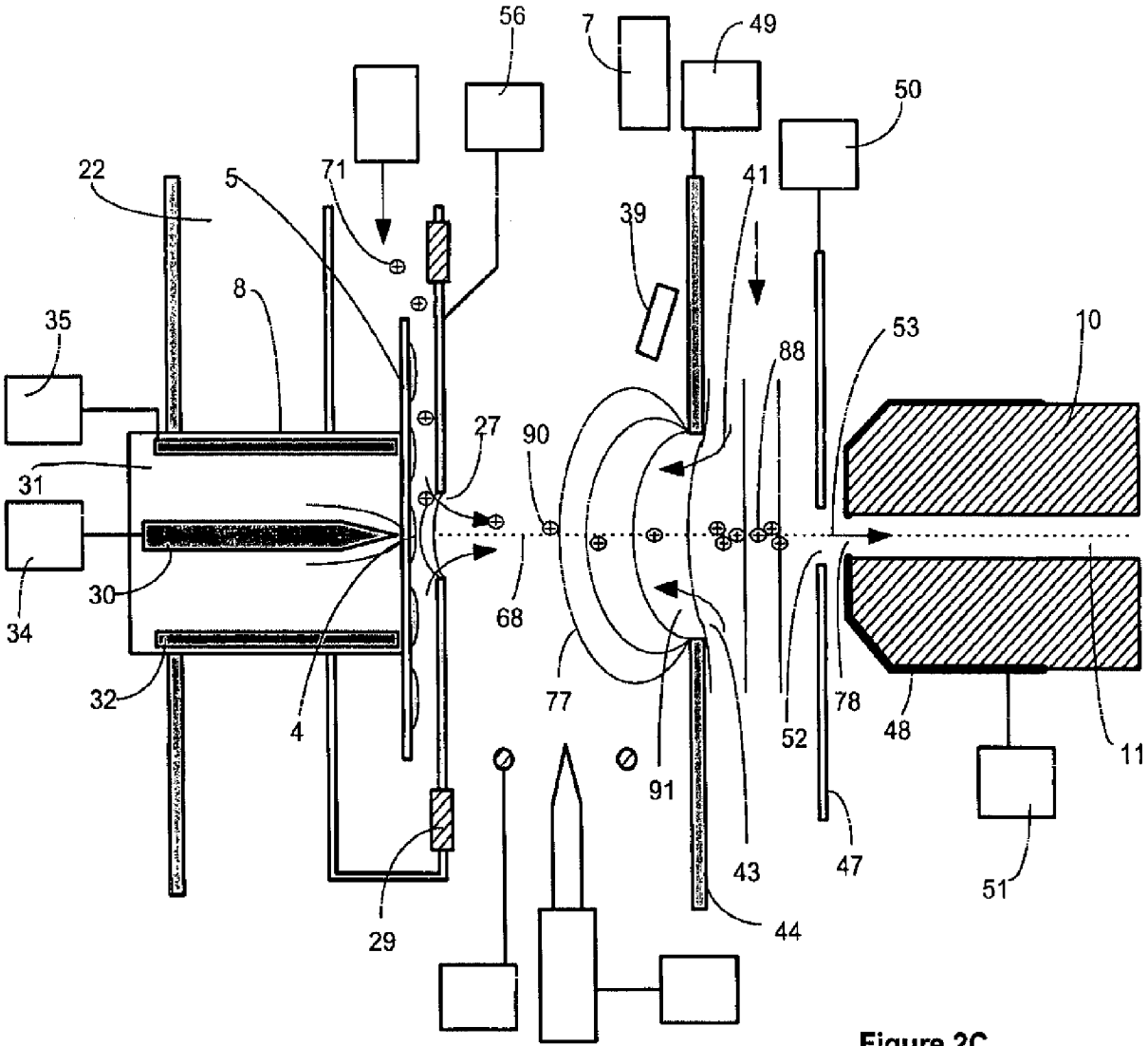
FIG. 2C is a diagram of the atmospheric pressure Laser Desorption Ionization source shown in FIG. 1 during the operating step of focusing the ion population produced into the orifice to vacuum.

In laser desorption operating mode, the voltages applied to electrodes 30, 28, 44, 47, 48, 63 and charged droplet sprayer 58 are set to direct ions 75 generated from charged droplet sprayer 58 to accumulate on the surface sample 4 on target plate 5 prior to desorbing sample 4 by laser pulse 40. Ion or charged species 75 generated from charged droplet sprayer 58 and ion species 71 entrained in target plate gas flow 23 are directed to the surface of sample 4 prior to desorbing sample 4 with laser pulse 40 as shown in FIG. 2A. The accumulation and subsequent laser desorption of positive polarity ions is illustrated in FIGS. 2A through 2C but the same sequence of steps can be applied for negative ion accumulation and laser desorption with the reversal of voltage polarities applied to electrodes. In FIG. 2A, appropriate voltages are applied to charged droplet sprayer 58, ring electrode 63 and electrodes 28 and 44 to produce positive polarity charged droplet spray 62. For illustration purposes, the potentials applied to charged droplet sprayer tip 61, ring electrode 63, electrode 28 and electrode 44 may be set to +4KV, +0V, −1KV and +1KV respectively. The voltage applied to electrically insulated charging electrode 30 through power supply 34 may by set to −10 to −20 KV with the shielding electrode voltage set close to −1 KV through power supply 35. The electric field formed at the sharp tip of charging electrode 30 penetrates dielectric target plate 5 and extends through opening 27 of electrode 28 into region 73 between electrodes 28 and 44 as shown in FIG. 2A.

Heated target gas 74 aids in drying charged droplets produced by charged droplet sprayer 58. Ions 75 generated from evaporating droplets produced from charged droplet spray 62 follow electric field lines 72 and are directed to the surface of sample 4 on dielectric target plate 5. Either concurrently or alternatively, charged species 71 entrained in target plate gas flow 23 pass between target plate 5 and electrode 28 and are attracted to the surface of sample 4 by the same attractive electric field formed by the electrical potential applied to charging electrode 30.

Charge 70 accumulates on the surface of sample 4 until the space charge limit is reached. When the space charge limit is reached additional positive polarity ions turned away from the surface of sample 4 and neutralized on electrode 28 Image charge 73, in this case electrons, are drawn to the tip of charging electrode 73 as positive ions accumulate on the surface of sample 4. Charging electrode 30 and sample 4 form a capacitor with a charge capacity in part determined by the electric field strength maintained between the surface of sample 4 and the tip of charging electrode 30. The tip sharpness of insulated charging electrode 30, the proximity of this tip to the surface of sample 4, the voltage applied to charging electrode 30 relative to the voltage applied to electrodes 28 and 44 and the dielectric constant of target plate 5 and insulation 31 will effect the electric field strength at the surface of sample 4. Charge may accumulate on the surface of sample 4 until the electric field is locally reduced and ultimately neutralized preventing additional ions of the same polarity from further accumulating on the surface of sample 4. Minimum charge migration or neutralization occurs on the surface of dielectric target plate 5 A single ion species or a mixture of ion species can be accumulated on surface 4 depending on the requirements of an analytical application. For example, if sample 4 comprises a mixture of proteins with a matrix such as Sinapinic acid typically used in Matrix Assisted Laser Desorption Ionization (MALDI), protons may be an optimal choice of charged species to accumulate on the surface of sample 4. Protons can be directed to the surface as protonated water or protonated methanol ions generated from charged droplet sprayer 58 or a charged droplet sprayer or APCI ion generator configured in target gas controller 24. Proteins form ions generally as protonated species so the protons accumulated on the surface of sample 4 will supply a source of protons to increase ionization efficiency during laser desorption of sample 4. Alternatively, metal ions such as sodium can be accumulated on the surface of sample 4 if carbohydrate analysis is required to enhance ionization efficiency. If sample 4 comprises a liquid such as water or a low volatility surface such as glycerol, accumulating ions can react with or attach to sample species in solution prior to laser desorption Infrared lasers can be used to desorb aqueous sample solutions at atmospheric pressure. Sample 4 may include no matrix and laser desorption may occur directly from the sample as is used with Direct Ionization Off Surfaces (DIOS) techniques Accumulating charged species may be in direct contact with sample molecules when no matrix is used on target plate 5 This direct charge species and sample species association can improve ionization efficiency for select sample types when compared with charge accumulation in the case where the sample is associated with a matrix. Different ion species may be supplied by charged droplet sprayer 58 and target gas controller 24. Ions species may be generated from charged droplet sprayer 58 and target gas controller 24 simultaneously or individually. Charged species production by either device may be rapidly switched off or on, if required during laser desorption ionization operation. Charged droplet sprayer 58 can be rapidly turned off and on by adjusting the relative potentials applied sprayer tip 61 and ring electrode 63

Figure 3:
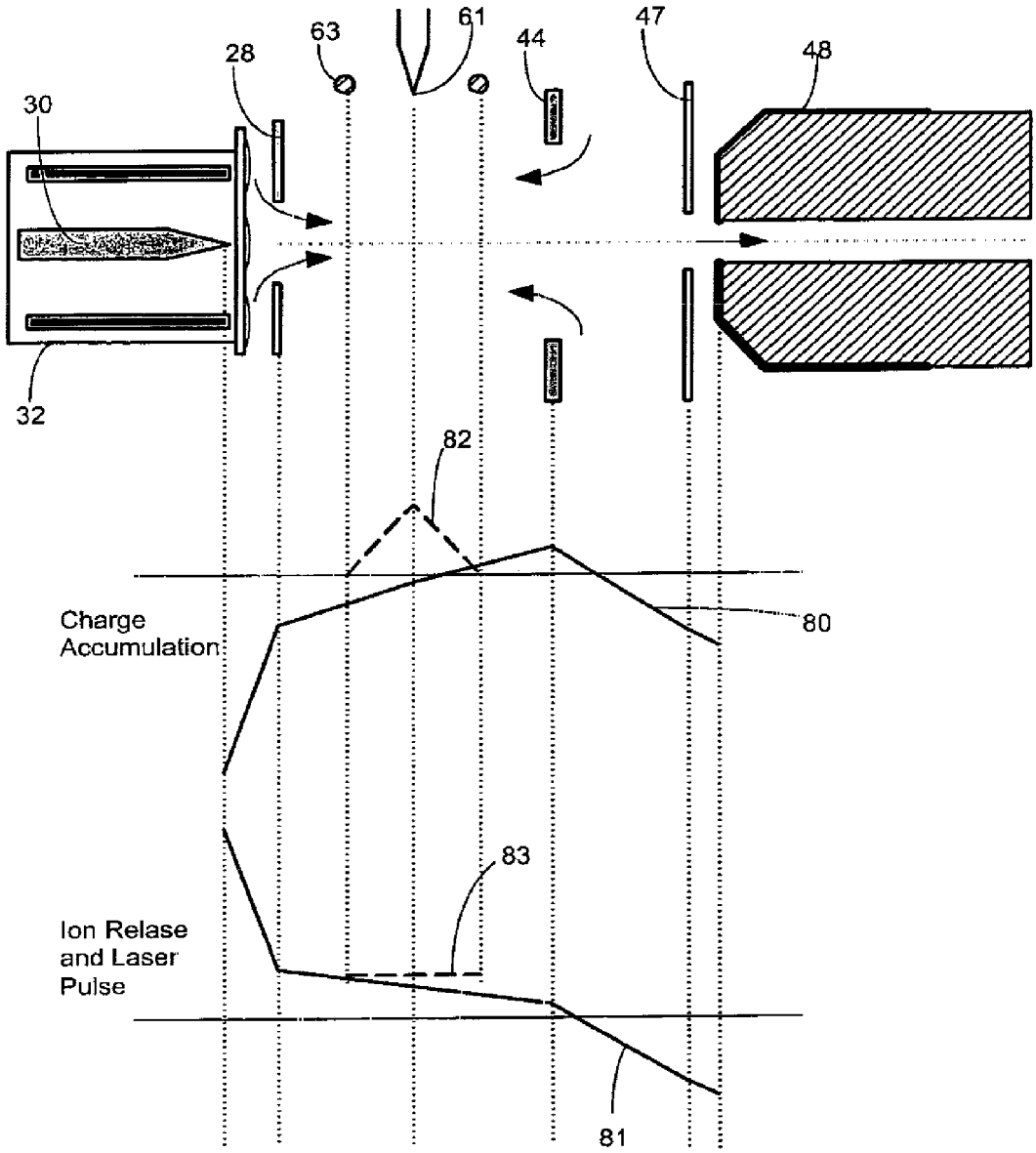
FIG. 3 is a diagram of one embodiment of the electric fields applied during surface charging and ion release and focusing operation in the atmospheric pressure Laser Desorption Ionization source shown in FIG. 1
Figure 4A:
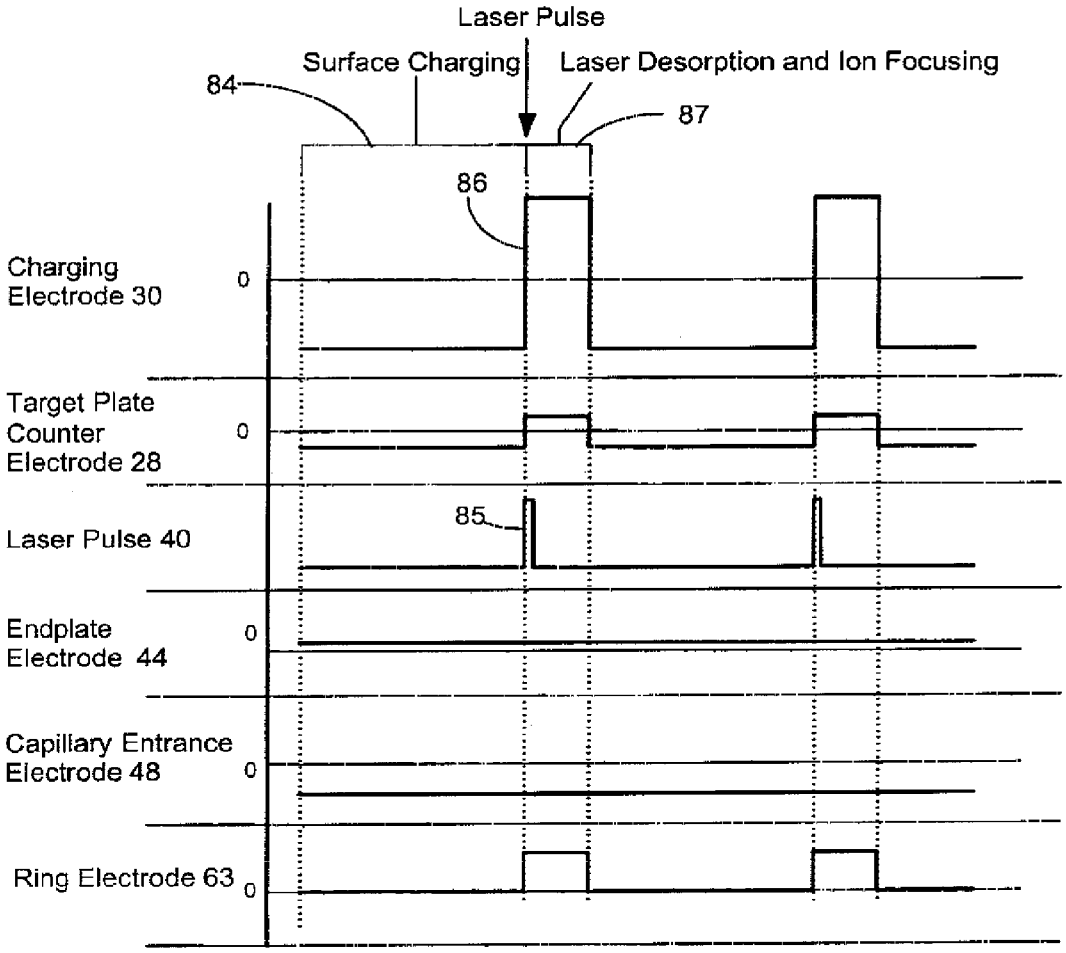
FIG. 4A is a timing diagram of one operating sequence embodiment used in the atmospheric pressure Laser Desorption Ionization source shown in FIG. 1.
Figure 4B:
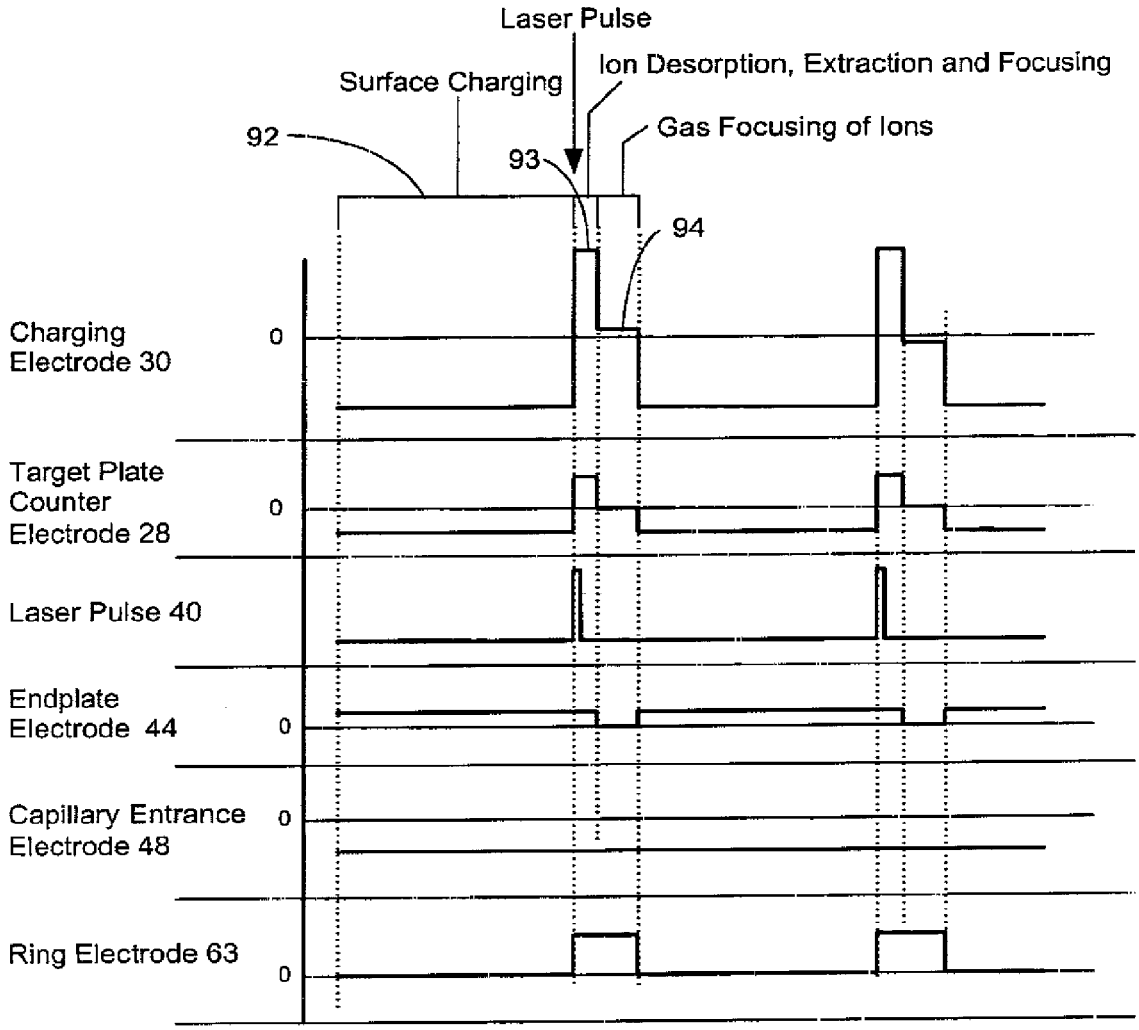
FIG. 4B is a timing diagram of a second operating sequence embodiment used in the atmospheric pressure Laser Desorption Ionization source shown in FIG. 1.

When sufficient positive charge has accumulated on the surface of sample 4, laser pulse 40 is applied to the surface of sample 4 from laser 7 to desorb sample from target plate 5. The voltage applied to charging electrode 30 is rapidly reversed just prior to, during or just after laser pulse 40 to release the charge from the surface of sample 4. This effectively reverses the potential across the capacitor formed by the charge accumulated on the surface of sample 4 and the image charge accumulated near the tip of charging electrode 30. The laser pulse step is illustrated in FIG. 2B where the attracting electric field 72 is gone and electric field 77 attracts ions desorbed from sample 4 toward entrance orifice 78 of capillary 10. FIG. 3 is a diagram of one set of electrical potentials that may be applied during the ion accumulation and ion desorption steps. Curve 80 shows one example of the relative potentials applied to Electrodes 30, 28 44, 47 and 48 during accumulation of positive charge on the surface of sample 4. Curve 82 represents the relative but off axis electrical potentials applied to charged droplet sprayer tip 61 and ring electrode 63 during production of positive polarity charged droplets from sprayer tip 61 and accumulation of positive polarity ions on the surface of sample 4. Curve 81 shows the reversal of voltage polarity applied to charging electrode 30 and 28 to facilitate desorption and ionization of sample components from sample 4 when laser pulse 40 is applied. The voltage applied to ring electrode 63 as shown by curve 83 is set to minimize distortion of the centerline focusing electric field directing desorbed ions into capillary entrance 78. Charged droplet sprayer nebulizing gas flow is switched off during the laser desorption and ion focusing steps. When charged droplet sprayer 58 is operated in non nebulizing Electrospray mode, the charged droplet spray turns off when the voltages on ring electrode 83 are set approximately equal to the voltage applied to sprayer tip 61 as shown in curve 83 or FIG. 3. The timing diagram of the voltage transitions illustrated in FIG. 3 is shown in FIG. 4A. The surface charging time period is followed by laser pulse 85 and a rapid change in voltage 86 applied to charging electrode 30. The voltage changes applied to Electrodes 30, 28 and 63 are maintained during the ion focusing period to allow time for desorbed ions from sample 4 time to reach capillary entrance 78 where they are swept through capillary bore 11 into vacuum by gas flow 53 In the example described, voltages applied to Electrodes 44, 47 and 48 remain constant during the sample charging, ion desorption and ion focusing steps illustrated in FIGS. 2A, 2B and 2C.

When positive reagent ions are generated from target gas controller 24, relative voltages can be set between electrodes 30 and 28 to allow these reagent ions to pass through opening 27 in electrode 28 and mix with neutral molecules 75 and ions 88 desorbed from sample 4. Through exchange or attachment of charge from the reagent ions to desorbed neutral species, the ionization efficiency of the desorption process is improved increasing mass to charge analysis sensitivity. As diagrammed in FIGS. 2B and 2C, reagent ions 90 mix with desorbed neutral species when the appropriate voltages are applied to electrodes 30 and 28 to direct reagent ions 71 through opening 27 and along centerline 68 moving as gas phase ions 90 toward capillary entrance 78. Before countercurrent gas flow 41 sweeps desorbed neutrals away from opening 43 in endplate electrode 44, reagent ions 90 have a the opportunity to collide with and exchange charge or attach to a neutral desorbed sample molecule. Target plate gas flow 74 meeting countercurrent gas flow 41 in region 73 form a stagnation and mixing area in region 71 that promotes charge exchange or attachment between reagent ions 90 and desorbed neutral species 75. Once a neutral sample molecule has been ionized in the gas phase, focusing fields 77 direct the ions towards capillary entrance 78. Reagent ions species may also be selected to promote desired gas phase reactions with desorbed analyte sample molecules. Reagent ion flow through opening 27 in electrode 28 can be stopped during the ion focusing step by applying the appropriate relative voltages between electrodes 30 and 28 to direct reagent ions to neutralize on electrode 28 before entering opening 27.

An alternative sequence of surface charging step 92, sample desorption, extraction and ion focusing step 93 and gas focusing step 94 is shown in timing diagram 4B. The charging and desorption steps illustrated by FIGS. 2A and 2B are similar to the two step sequence of FIG. 4A as shown in the timing diagram shown in FIG. 4B. However, as the desorbed ions 88 approach capillary entrance orifice 78, the potentials applied to electrodes 30, 28, 44, 47 and 48 are set approximately equal, as shown in step 94 of timing diagram 4B, to allow gas dynamics forces to dominate ion motion, sweeping ions into and through capillary bore 11. The application of steep electric fields near capillary entrance 78 serve to focus ions toward the centerline but can also drive ions into the edge of capillary entrance electrode 48 where they are neutralized. Reducing the electric field just before the ions reach capillary entrance orifice 78 allows initial ion focusing as desorbed ions traverse from sample 4 to capillary entrance orifice 78 but reduces the amount of ion impingement occurring on capillary entrance electrode 78 as the ions enter capillary bore 11. This additional gas dynamic ion focusing step improves ion transport efficiency into vacuum increasing sensitivity in mass to charge analysis. The timing of the voltage switch to the gas focusing step can be optimized for any set of focusing voltages applied by using a calibration procedure in which the duration of ion desorption, extraction and focusing step 93 is varied to find the maximum mass spectrometer signal response. The diagrams of timing sequences and steps shown in FIGS. 2A through C, FIG. 3 and FIGS. 4A and 4B are given to illustrate examples of operating sequences, however other switching patterns or variations on switching patterns can be employed to optimize performance for different applications. Voltages can be applied to maximize ionization and sampling efficiency of negative ions. Variations of step sequences and additional steps may be added to sequences to maximize performance and to optimize for differences in samples, applications, and ion source lens geometries, gas composition, temperature and flow rates. For example multiple laser shots can be conducted on the same spot or on different spots while the voltage applied to charging electrode 30 is transitioned from charge accumulation to charge rejection potentials. Laser beam 40 spot can be moved or target plate 5 can be moved between each laser shot in a series.

Figure 2D:
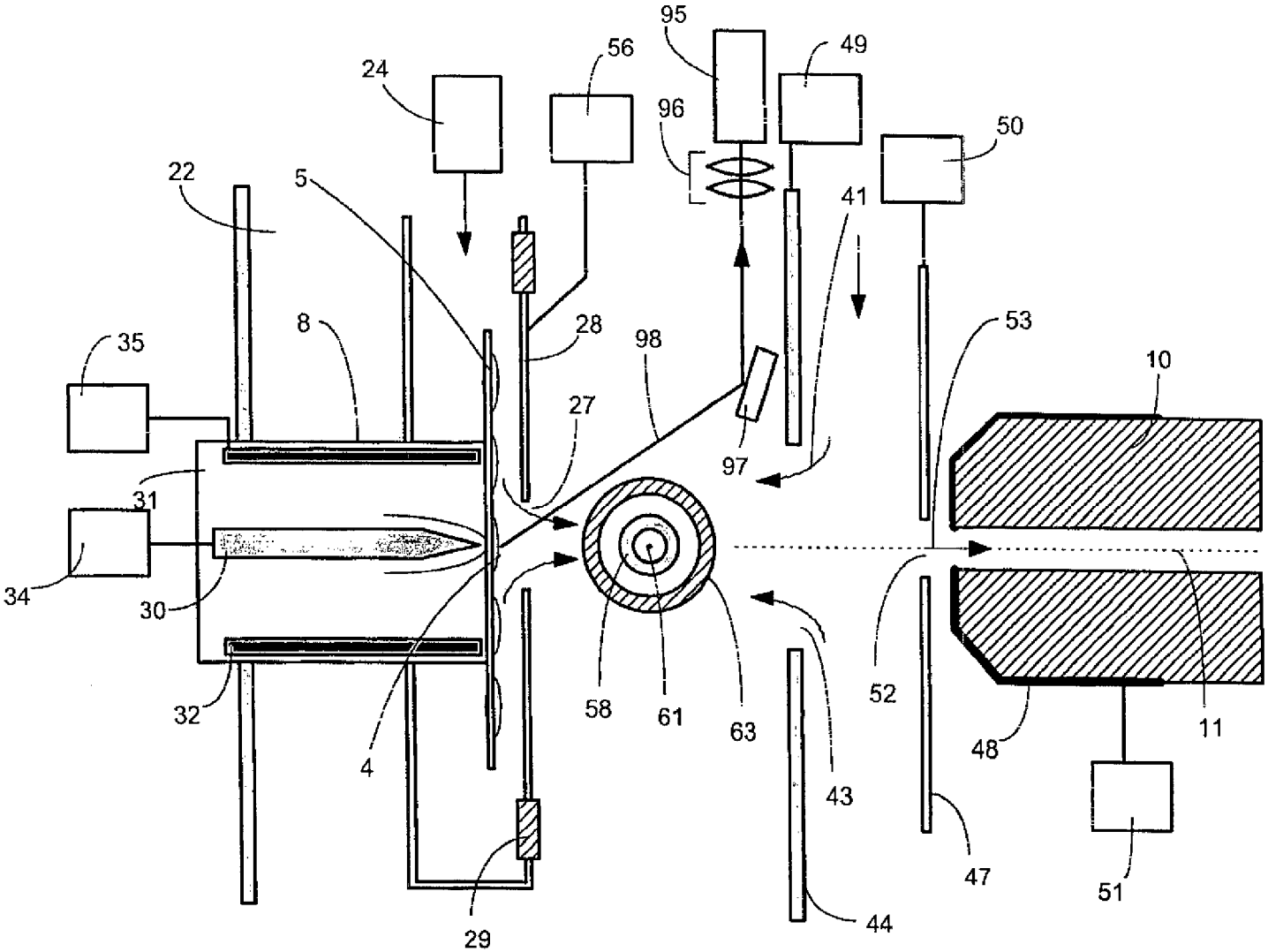
FIG. 2D is a diagram of the atmospheric pressure Laser Desorption Ionization source shown in Figure with the view turned 90 degrees showing a imaging apparatus with magnification.

An alternative embodiment, or addition to the embodiment of the invention, is diagrammed in FIG. 2D. FIG. 2D is a diagram of laser desorption ion source 1 viewed from an angle rotated 90 degrees to the view shown in FIGS. 2A through 2C. Charged droplet sprayer 58 is with sprayer tip 61 is pointing orthogonal to the viewing plane. Configured 90 degrees rotated from charged droplet sprayer 58 and Laser 7 is optical imaging device 95 with image magnifiers 96 and mirror 97. Imaging device 95 may comprise a video camera for digital imaging or a microscope for manual viewing of the sample surface. Imaging device 95 is used to provide and image sample surface 4 allowing optimization of the target plate 5 position relative to the tip of charging electrode 30 and laser pulse 40. Positioning the tip of charging electrode 30 under a sample feature will maximize charge accumulation at that location Laser desoption ionization efficiency can be improved with sample mixed in MALDI matrices when a laser pulse is applied to a MALDI crystal located using optical imaging with feedback to the target plate x-y translator stage 26. Less ion yield results when a laser pulse impinges on a MALDI matrix in a location where no matrix crystals are present. Imaging device 95 can be used to located the position of MALDI matrix crystals in sample 4. Based on the image information and sample coordinates provided, target plate 5 is moved to line up the tip of charging electrode 30 and laser pulse 40 with the MALDI matrix crystal position in sample 4. The position of laser beam 40 hitting sample 4 can be adjusted independent of target plate 5 movement or the location of the tip of charging electrode 30. Mirror 39 can be configured with a fine resolution movement device such as a galvanometer to allow rapid steering of laser beam 40 impinging on sample 4. Alternatively, the position of charging electrode 30 can be positioned using a separate x-y translator stage to provide movement of charging electrode 30 independent of target plate 5 x-y movement. Additional illuminating devices such as lower power lasers can be incorporated into imaging device 95 to enhance the image from florescent dyes used to stain sample 4. For example, if sample 4 is a tissue slice and laser desorption source 1 is used to conduct molecular imaging of stained tissue samples, individual cells can be optically imaged using imaging device 95 to allow laser charge accumulation on and laser desorption from selected cells in tissue sample 4. Laser beam 40 can be focused down to small spot dimensions and target plate 5 can be fabricated as a very thin dielectric sheet allowing the insulated sharp tip of charging electrode 30 to rest just under but very close to an imaged and selected cell. Laser desorption ionization from individual cells or from a small group of cells in a tissue can be performed with an appropriately focused laser spot and a small local charge accumulation area. Imaging device 95 can also be used determine when a sample has been depleted or damaged after several laser shots.

Target plate 5 and charging electrode 30 may be configured in alternative embodiments. Target plate 5 may be configured as a moving dielectric belt. The eluant from a liquid chromatography (LC) run can be deposited on the moving belt as a continuous track or spots with a MALDI matrix added on line. A second track of calibration sample can be added along side the LC sample track Two charging electrodes can be positioned under each track or spot train to provide simultaneous charging of both LC and calibration samples. Laser beam 40 can be rastered across both tracks or spots during the desorption step to generate ions from both the LC and calibration samples as the dielectric belt target moves past opening 27 of electrode 28. The charging and laser desorption steps can occur rapidly with multiple step cycles conducted per second to maximize sample throughput.

Figure 5:
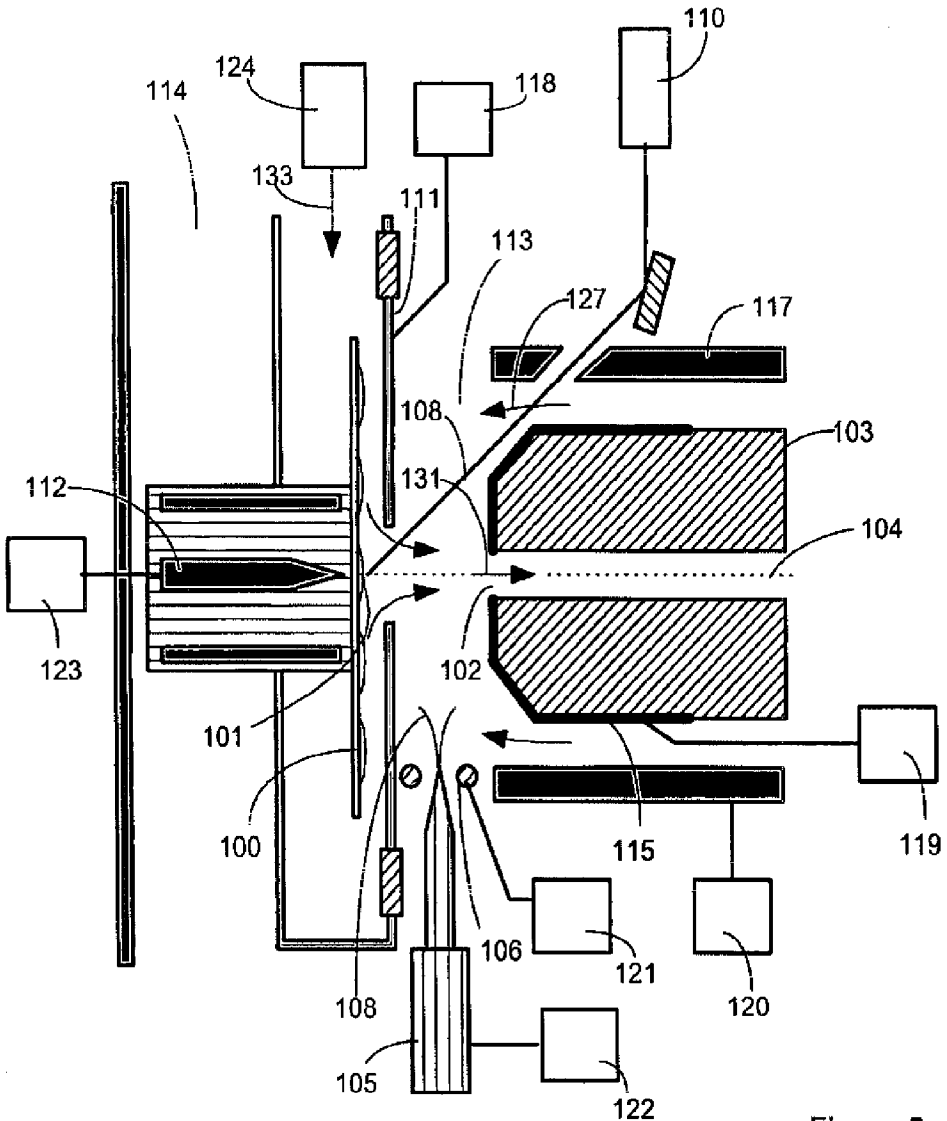
FIG. 5 is a diagram of an atmospheric pressure Laser Desorption Ionization source, incorporating surface charging, with the target surface configured in proximity to the orifice into vacuum.

An alternative embodiment of the invention is diagrammed in FIG. 5 where electrodes 44 and 47 are removed and target plate 100 is positioned closer to the capillary bore entrance 102. Charged droplet sprayer 105 produces charged droplet spray 108 as described in FIG. 2A above. Evaporating charged droplets generate ions that can be directed to accumulate on the surface of sample 101 to enhance the ionization efficiency of laser desorption or directed toward capillary bore entrance 102 when conducting Electrospray or pneumatic nebulization ionization of a sample substance. Alternatively, charged droplet sprayer 105 may be configured as an APCI, a photoionization, glow discharge, corona discharge or other ionization source to generate of charged species for charge accumulation on sample 101 prior to laser pulse 108. Multiple alternative ionization probes can be configured in one ion source with laser desorption producing ions in region 113 of ion source 114 shown in FIG. 5 or region 73 of ion source 1 shown in FIGS. 1 and 2A through 2D. Different ionization methods can be separately controlled to provide ion accumulation on sample 101 and 4 prior to laser desorption or to generate ions that are directed into vacuum through capillary bore 104 and 11 for mass to charge analysis. Combinations of multiple probes can be run simultaneously or independently in one ion source without the need to change hardware.

Figure 6:
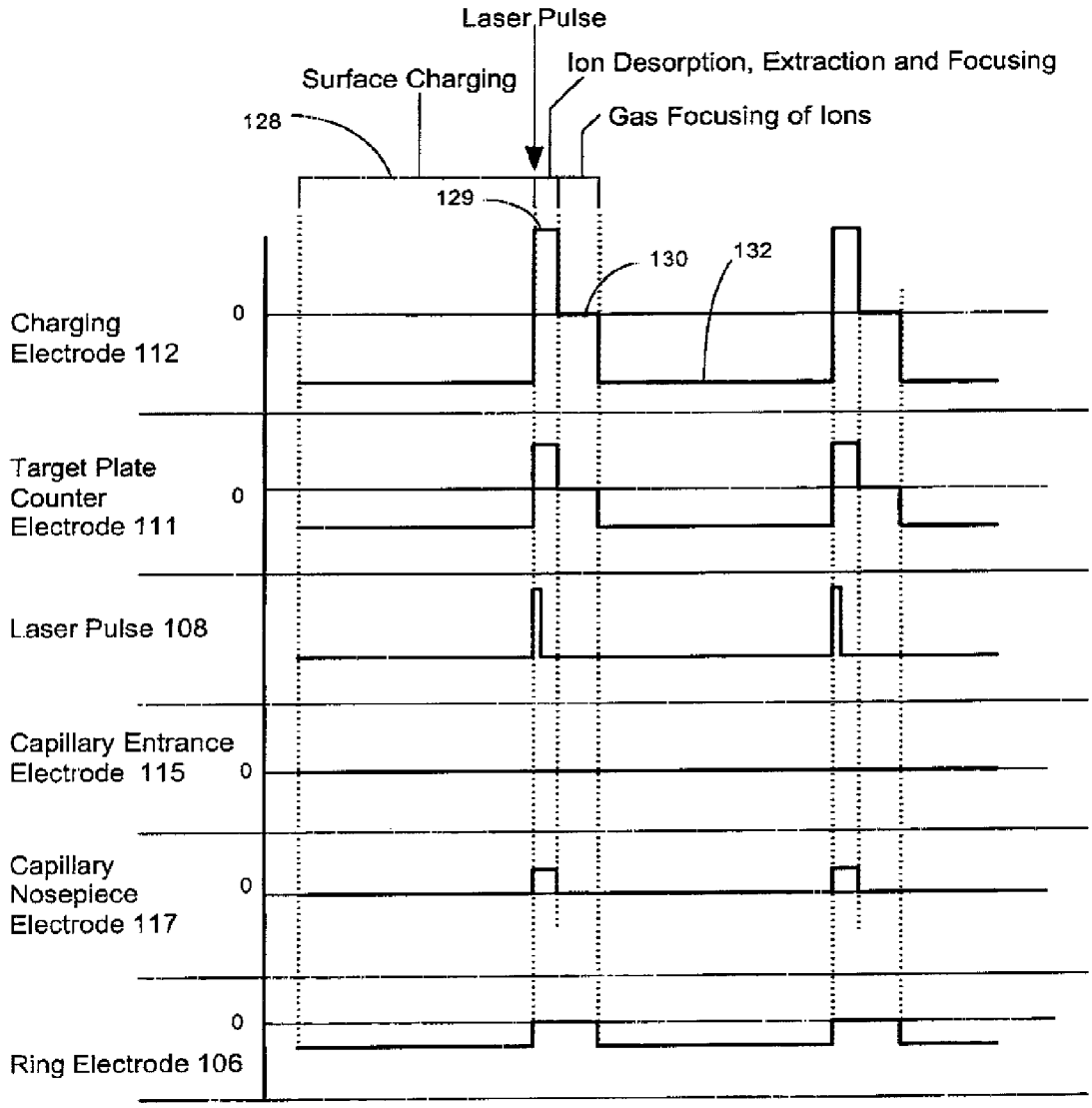
FIG. 6 is a timing diagram of the of one operating sequence embodiment used in the atmospheric pressure Laser Desorption Ionization source shown in FIG. 5

The operating sequence of laser desorption ion source 114 shown in FIG. 5 is analogous to that illustrated in timing diagram 4B described above. In positive ion operating mode, a negative voltage is applied to charging electrode 112 through power supply 123 relative to the voltages applied to target plate counter electrode 111, capillary entrance electrode 115, capillary nosepiece electrode 117, charged droplet sprayer 105 and ring electrode 106 through power supplies 118, 119, 120, 122 and 121 respectively. Charged species generated by charged droplet sprayer 105 and/or target gas controller 124 are directed to the surface of sample 101 on dielectric or semiconductor target plate 100. Charge is accumulated on the surface of sample 101 until the space charge limit is reached for the relative electrode voltages applied. The time period 128 of this sample charging step is illustrated in the timing diagram shown in FIG. 6. Laser pulse 108 is fired from laser 110 to desorb material from sample 101 as the voltages on electrodes 112, 106 and 117 are changed to facilitate extraction of desorbed ions from the surface of sample 101 and focusing of the ion population produced into capillary bore entrance 102. The ion desorption, extraction and focusing step 129 is shown to occur simultaneously with laser pulse 108. Alternatively, the electrode voltage transitions can occur before or after the laser pulse and additional laser pulses can occur during or after such electrode voltage transition. Prior to the desorbed ion population reaching capillary bore entrance 102, the relative voltages applied to electrodes 112, 111, 106, 115 and 117 are set to be approximately equal to reduce the electric field in region 113 between target plate 100 and capillary entrance electrode 115. As illustrated in the timing diagram shown in FIG. 6, shortly after the ion extraction and focusing voltages are applied, the relative voltages of electrodes are set to be approximately equal to initiate gas focusing step 130. With a minimum electric field in region 113, the desorbed ions are swept into capillary bore by gas flow 131. The reduction of the electric field in region 113 prior to the desorbed ions reaching capillary entrance electrode 115 reduces neutralization of ions on electrode 115 and improves ion transmission efficiency into vacuum through capillary bore 104. The duration of the gas focusing step 130 time period is sufficient to allow the desorbed ion population to enter capillary bore 104 prior to switching the electrode potentials back to ion accumulation step 132. Heated countercurrent gas flow 127 sweeps neutral species away from capillary bore entrance 102 during ion extraction and focusing step 129 and provides the carrier gas for sweeping ions into vacuum. As described for laser desorption ion source 1, gas phase ion species may generated in target gas controller 124 and carried in target gas 133 to charge the surface of sample 101 and provide subsequent gas phase ionization of desorbed neutral molecules traversing region 113. The charging, desorption and gas focusing steps can be conducted in rapid succession cycling multiple times per second to minimize sample analysis time. As described above the laser pulse 108 spot, target plate 100, and charging electrode 112 positions can be positioned independently with or without optical imaging to optimize analytical performance for a given application.

Figure 7:
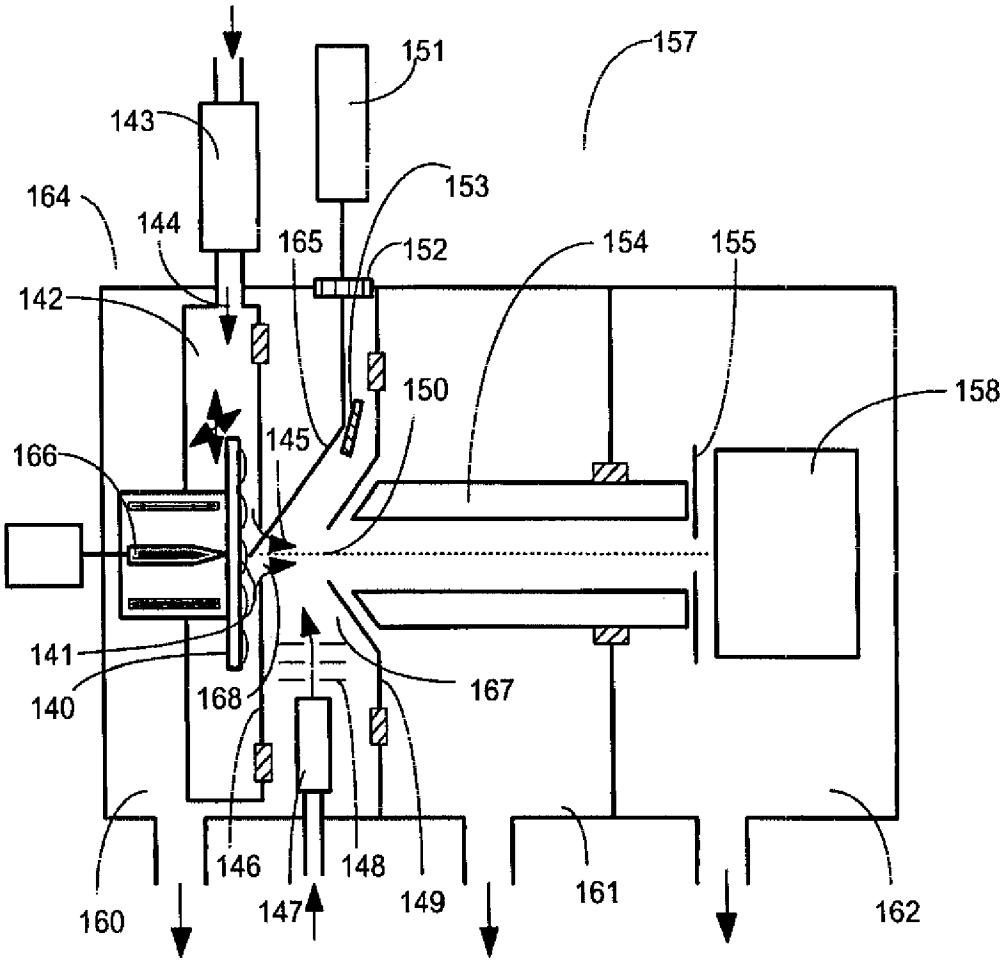
FIG. 7 is diagram of an intermediate pressure Laser Desorption Ionization source, incorporating surface charging, interfaced to a mass spectrometer.

An alternative embodiment of the invention is diagrammed in FIG. 7 where target plate 140 and target plate chamber 142 are positioned in vacuum stage 160. The pressure maintained in vacuum stage 160 may range from above 4 torr to below 10.sup.-4 torr depending on the analytical application, total gas flow through target plate gas controller 143 and ion generator 147 and vacuum stage 160 pumping speed. Ion or charged species generator 147 with ion focusing electrodes 148 and target gas controller 143 may comprise a chemical ionization, glow discharge, electron bombardment, photoionization or other vacuum compatible ion source to generate charged species. Similar to the operation of the atmospheric pressure ion sources described above, charging of the surface of sample 141 occurs in intermediate pressure laser desorption ion source 164 prior to applying laser pulse 165 from laser 151 to desorb sample components and ions from sample 141. Charged species in either positive or negative ion operating mode are accumulated on the surface of sample 141 by applying the appropriate potentials as described above to charging electrode 166, target plate counter electrode 146, skimmer electrode 149, ion generator 147 and focusing electrodes 148. Ion species are supplied from target gas controller 143 and ion generator 147 individually or simultaneously during the sample charging step. The voltages applied to electrodes 166, 146, 149 and 148 and ion generator 147 are rapidly changed while laser pulse 165 is applied to aid in desorbing, extracting and ionizing sample components from sample 141. After ion and neutral sample components have been desorbed and extracted from sample 141, voltages applied to these electrodes are then changed to optimize transmission efficiency of the desorbed ion population through skimmer opening 150 into ion guide 154. Timing sequence similar to that shown in FIGS. 4A, 4B and 6, can be applied in the operation of intermediate pressure laser desorption ion source 160. Additional gas phase ionization of neutral desorbed sample molecules can occur through charge exchange or ion attachment with ion species supplied in target gas 144 as the desorbed sample plume expands in region 167 between the target plate and skimmer 149. Ion guide 154 can be operated as an ion trap to allow additional reaction time between reagent ions supplied from target plate gas controller 143 trapped in ion guide 154 to react with desorbed neutral species flowing through skimmer opening 150 and into ion guide 154. The accumulation of charge on the sample prior to desorption and addition of further gas phase ionization increases the ionization efficiency and sensitivity of intermediate pressure laser desorption ionization and allows for ion molecule reactions with sample components prior to, during or after laser desorption of sample 141.

Target plate gas flow 144 aids in directing reagent ions to the surface of sample 141 during the sample charging step Target plate gas flow 145 exiting target plate chamber 142 through opening 168 in electrode 146 provides a gas load in vacuum stage 160 and, passing through skimmer 149 opening 150 into vacuum stage 161, provides a local increase in background gas pressure at the entrance of ion guide 154. The flow of target plate gas 145 through electrode 146 serves to collisionally damp translational energy spread of ions generated in the desorption process. The translational energy spread of the desorbed ion population continues to be reduced through collisional cooling in ion guide 154. Desorbed ions can be focused in region 167 by applying the appropriate relative voltages to electrode 146 and skimmer electrode 149. Ions accelerated and focused between electrode 146 and skimmer opening 150 experience collisions with background gas that may increase or decrease internal energy of the ions depending on the rate of acceleration imposed by the applied voltages. If required, ion internal energy can be increased in region 167 to decluster or fragment of ions prior to conducting mass to charge analysis in mass to charge analyzer 158 Intermediate pressure laser desorption ion source mass spectrometer 157 comprises vacuum stages 160,161 and 162. Sufficient vacuum pumping is provided in each vacuum stage to allow optimal performance of elements within each vacuum stage. Less than three or more than three vacuum stages may be configured in alternative embodiments of the invention to provide optimal performance for specific mass analyzer types. Ion guide 154 as shown in FIG. 7 extends into multiple vacuum stages and serves as the gas conductance orifice between vacuum stages 161 and 162. Ions traversing ion guide 154 pass through exit electrode 155 into mass to charge analyzer and detector 158. Voltage applied to exit electrode 155 may be increased relative to the offset potential applied to ion guide 154 to trap ions in ion guide 154. Trapped ions can be released from ion guide 154 by lowering the voltage applied to exit electrode 155. The release of trapped ions from ion guide 154 need not be sychronized with laser pulses in ion source 160 allowing decoupling of mass spectrometer analysis timing with the pulsed production of ions in ion source 160. Ions from multiple laser desorption shots may be stored in ion guide 154 before releasing trapped ions into mass to charge analyzer 158.

Figure 8A:
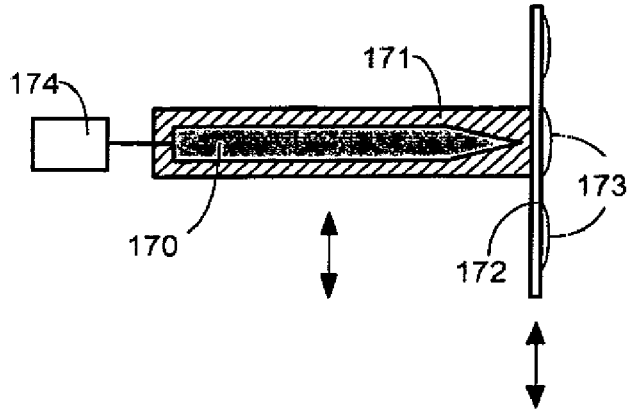
FIG. 8A is a diagram of the one embodiment of a Laser Desorption target surface configured with an insulated charging electrode.
Figure 8B:
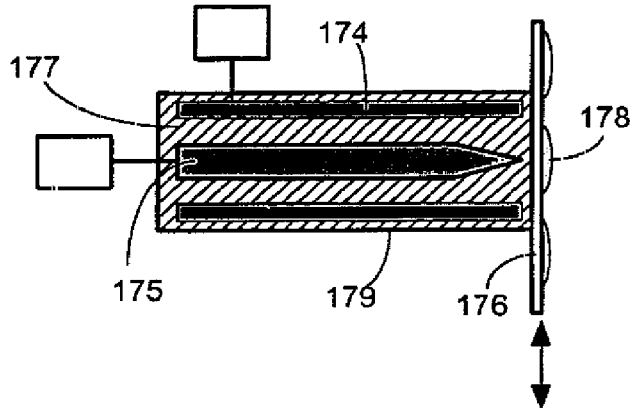
FIG. 8B is a diagram of an alternative embodiment of a Laser Desorption target surface configured with an insulated and shielded charging electrode.
Figure 8C:
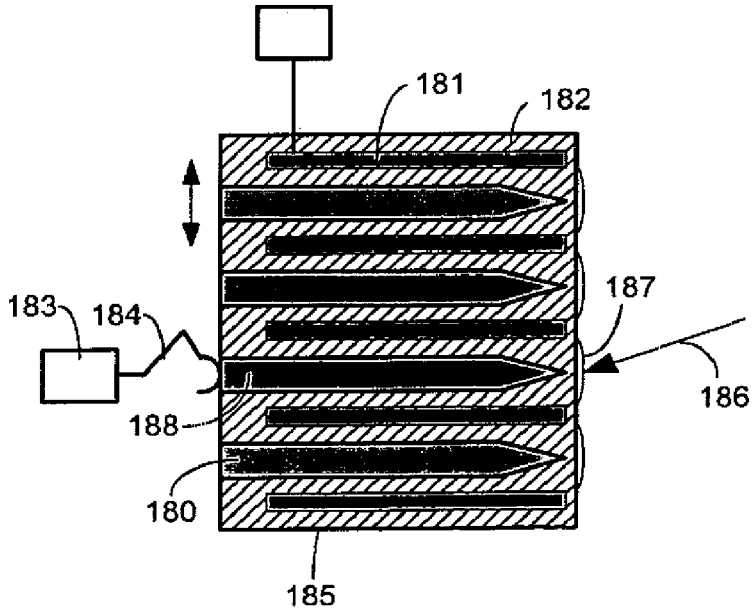
FIG. 8C is a diagram of an alternative embodiment of a Laser Desorption target surface configured with an array of insulated and shielded charging electrodes.

Alternative embodiments of sample target plates, charging electrodes and laser optics assemblies are diagrammed in FIGS. 8 and 9. FIG. 8A shows charging electrode 170 insulated by dielectric insulator 171 in contact with the opposite side of dielectric target plate or belt 172 from sample spots or lines 173. Voltage is applied to charging electrode 170 through Power supply 174. In the embodiment shown in FIG. 8A, charging electrode 170 is not surrounded by a shielding electrode. This allows the attractive electric field to extend over a broader region on target plate 172 during the charging of sample 173 prior to applying a laser pulse. The additional ions collected during sample charging are available for gas phase ionization of sample molecules after the laser pulse desorption and ion extraction step improving ionization efficiency. Charging electrode 170 can be fixed in position with target plate or belt 172 moving over it or both charging electrode 170 and target plate 172 can be translated independently to optimize performance Cylindrical shielding electrode 174 is added to the charging electrode assembly 179 in FIG. 8B to constrain the electric field formed by charging electrode 175 during the sample charging and desorption and ion extraction steps. Shielding electrode 174 prevents ions in the target gas from being attracted to the back side of target plate or belt 176 during the sample charging step. Charging electrode 175 with shielding electrode 174 insulated by dielectric insulator 177 can be fabricated with very small dimensions. A small diameter charging and shielding electrode assembly contacting a thin target plate or belt allows charging of a small sample area when desorbing sample from specific spatial regions of sample 178. The smaller dimensions of these elements coupled with a small laser spot size allows improved spatial resolution when desorbing sample from surfaces. This is advantageous, for example, when selectively desorbing material from specific cells or groups of cells in a tissue sample. Target plate or belt 176 is moved along the surface of charging electrode assembly 179 while remaining in contact with dielectric material 177 or the tip of charging electrode 175 Higher relative electrical potentials can be applied to charging electrode 179 if it is entirely insulated in dielectric 177. Shielding electrode 174 may be incased in or surrounding insulator 177. Multiple charging electrodes 180 with common shielding electrode 181 are insulated in dielectric 182 that also serves as the sample target surface in target plate assembly 185 shown in FIG. 8C. As charging electrode and target plate assembly 185 are translated to align laser pulse 186 with each sample spot 187, electrical contact is made with aligned charging electrode 188 and power supply 183 through spring contact 184. Integrated assemblies 185 have the advantage that shorter distances and more reproducible tolerances can be maintained between sample spots 187 and the tip of charging electrodes 188 This allows more reproducible and higher charging of sample surfaces to be achieved for different sample spots and for different target plates.

Figure 9A:
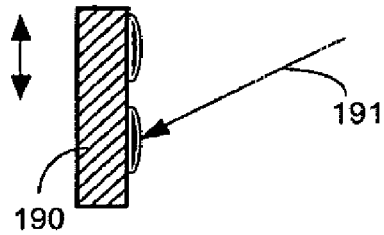
FIG. 9A is a diagram of one embodiment of a Laser Desorption target surface
Figure 9B:
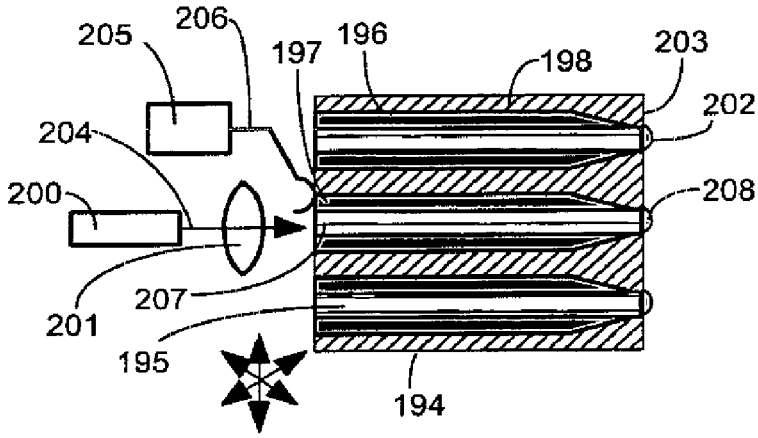
FIG. 9B is a diagram of an alternative embodiment of a Laser Desorption target surface comprising an array of charging electrodes with integral fiber optics for applying a laser pulse to the back side of the sample.

FIG. 9A shows a conventional laser desorption target plate 190 typically used for MALDI applications where laser beam 191 impinges on the front side of target plate 190 with no prior charging of sample. Typically target plate or the surface of target plate 190 comprises a conductive material to prevent the buildup of charge during laser desorption operation. The invention comprises elements and configurations that provide improved performance but depart from configurations employed conventional laser desorption ion sources that utilized target plates as shown in FIG. 9A. Embodiments of laser desorption target plates shown in FIGS. 8A through 8C and 9B through 9D contain elements and configurations not employed in laser desorption ion sources found in the prior art. A diagram of laser desorption target plate assembly 194 comprising fiber optic bundles 195 surrounded by charging electrodes 196 configured in dielectric block 198 is shown in FIG. 9B. Sample 202 is deposited on the end of each fiber optic bundle 195 on target plate surface 203. Laser pulse 204 from laser 200 is focused through optical lens assembly 201 and sent through a portion of fiber optic bundle 207 to impinge on the back side of sample spot 208. Laser pulse 204 can be directed to different areas of sample spot 208 by sending laser pulse 204 through different areas of fiber optic bundle 207. This can be achieved by steering laser beam 204 or by moving target plate assembly 194 using x, y and z axis translation. Voltages are applied to charging electrode 197 from power supply 205 through spring contact 206 to allow charging of the surface of sample spot 208 prior to applying laser pulse 204. The embodiment of the invention shown in FIG. 9B allows close positioning between a sample and an orifice into vacuum or an adjacent pumping stage. The laser optics are simplified and the laser beam is oriented perpendicular to the sample surface allowing a smaller laser beam spot size. Alternatively, sample spots or lines 208 may be mounted on an optically transparent plate and the plate can be slid over the exit end of fiber bundle 207. This would allow more rapid loading and running of sample plates without the need to clean the exit end of fiber optics bundle 207 between sample runs. A lens may be added to the exit end of fiber optic bundle 207 or incorporated in to a glass target plate to allow tighter focusing of laser beam 204 as it exits fiber optic bundle 207.

Figure 9C:
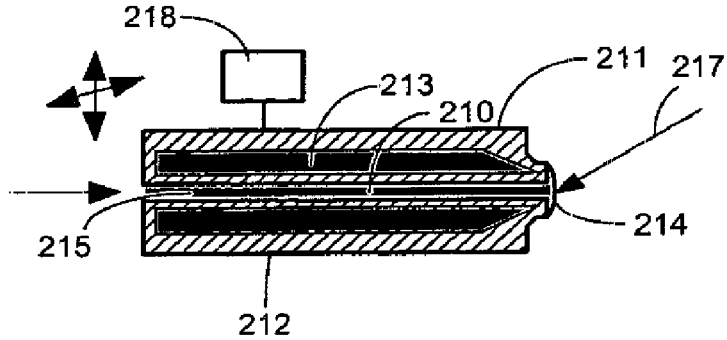
FIG. 9C is a diagram of a renewable liquid Laser Desorption target surface with liquid sample delivered to the target surface through a liquid flow channel.
Figure 9D:
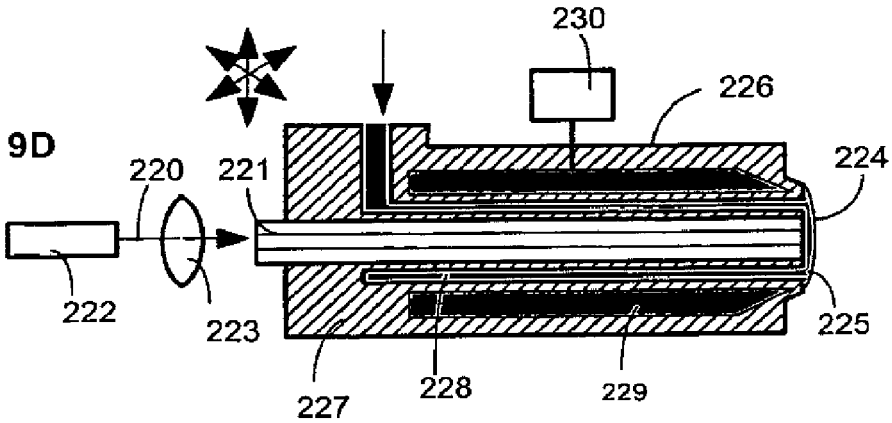
FIG. 9D is a diagram of a renewable liquid Laser Desorption target surface with integral fiber optics for applying a laser pulse to the back side of the sample.

A liquid sample 210 is introduce through bore 215 of dielectric element 211 of liquid surface laser desorption probe 212 diagrammed in FIG. 9C. Charging electrode 213 is electrically insulated from solution 210 in dielectric element 211. If solution 210 has low conductivity or is electrically floating, charge can be accumulated at surface 214 and in bore 215 when a high potential of opposite polarity is applied to insulated charging electrode 213 through power supply 218. Charge species accumulating on the surface of and in liquid 210 are delivered to liquid surface 214 prior to laser pulse 217 as described above for the solid surface laser desorption samples. Liquid 210 can flow through channel 215 or be loaded as a static sample during laser desorption ionization. Desorbed ions can be formed by laser desorption of sample components from water using infared lasers. Glycerol can be used as a liquid surface with low volatility in atmospheric pressure and intermediate pressure laser desorption ion sources. Precharging the liquid surface prior to applying a laser pulse can improve the ionization efficiency of such samples during laser desorption. In an alternative embodiment of liquid sample laser desorption probe 226, laser pulse 220 is applied to the underside of liquid sample surface 224 as diagrammed in FIG. 9D. Fiber optic bundle 221 passed through dielectric block 227. Liquid sample 225 is introduced through annulus 228 forming sample surface 224 as it exits annulus 228.

Charging electrode 229 is electrically insulated in dielectric block 227 with voltage applied through power supply 230. Precharging of electrically floating surface 224 and solution 225 can occur when an opposite polarity electrical potential is applied to charging electrode 226 attracting gas phase charged species to surface 224 When saturation of charging in electrically isolated solution 225 is achieved, laser 222 delivers laser pulse 220 through optical focusing elements 223 and fiber optic bundle 221 to laser desorb sample liquid 225 from surface 224. Liquid sample solution 225 may contain matrix components that absorb the wavelength of laser light used to enhance laser desorption efficiency.

Increased flexibility in target plate design and laser desorption source operation can be achieved while improving performance by separating the laser desorption region from the ion focusing region into a vacuum orifice in atmospheric pressure laser desorption ion sources. An alternative embodiment of the invention in which the ion generation and sampling regions are separated is diagrammed in FIGS. 10A through 10C. Laser desorption ion source 240 comprising target plate chamber 241 with target plate 270 and charging electrode 244 is interfaced to three stage vacuum system 288 with mass to charge analyzer and detector 267. Target plate chamber 241 is separated from endplate electrode 255, focusing electrode 256 and capillary entrance electrode 271 by annular electrode assembly 252. No line of sight exists between sample 245 and capillary entrance 259 reducing the transport of contamination neutrals and charged particles into vacuum minimizing contamination vacuum ion optics and decreasing chemical noise in acquired mass spectrum. Ion focusing region 272 where ions are focused into vacuum orifice 259 is separated from ion generation region 251 allowing independent optimization of both functions. Charge droplet sprayer 274, employing pneumatic nebulization, is positioned in center section 275 of annular electrode assembly 252 with face electrode 253 serving as the ring electrode for charged droplet sprayer 274. Alternative ion generation means as described above for alternative ion source embodiments, can be can be configured in laser desorption ion source 240 replacing pneumatic nebulization charged droplet sprayer 274. In the embodiment shown, charged droplet sprayer 274 is positioned on the centerline 285 of ion source 240 spraying toward sample 245. Target plate gas controller 242, with similar configurations and functions as described above, supplies heated target gas 243. If required, ions 247 can be generated in target plate gas controller 242 and delivered to target plate chamber 241 entrained in target gas flow 243. Target plate gas flow 243 exits target plate chamber 241 through opening 287 in target plate counter electrode 250. Target plate gas flow 288 entering region 251 directly opposes nebulization gas flow 280 from charged droplet sprayer 274 forming a gas stagnation and mixing region in region 251.

Figure 10A:
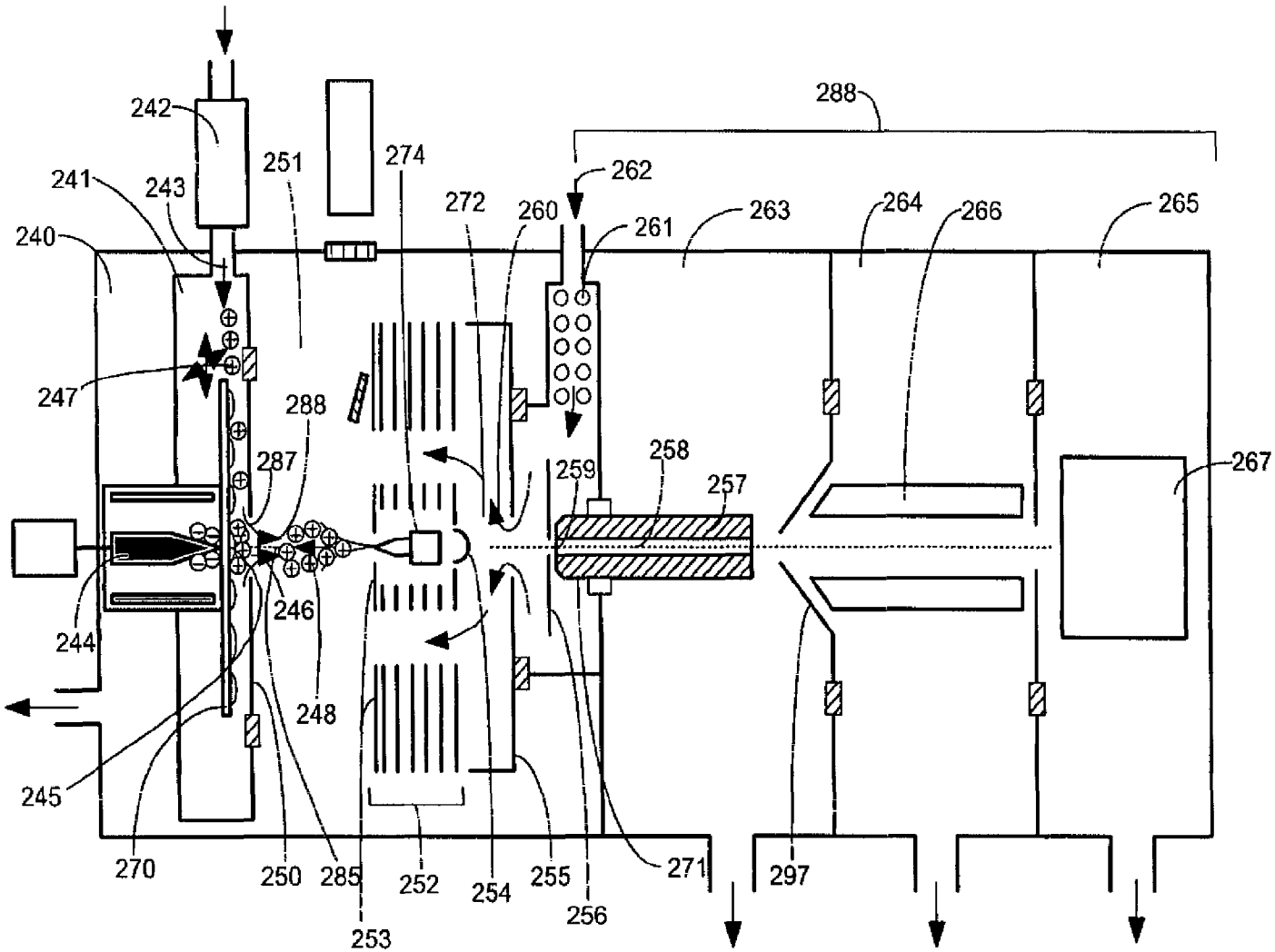
FIG. 10A is a diagram of an atmospheric Laser Desorption Ionization source comprising surface charging and a annular ion focusing lens embodiment interfaced to a mass spectrometer during the operating step of surface charging.
Figure 10B:
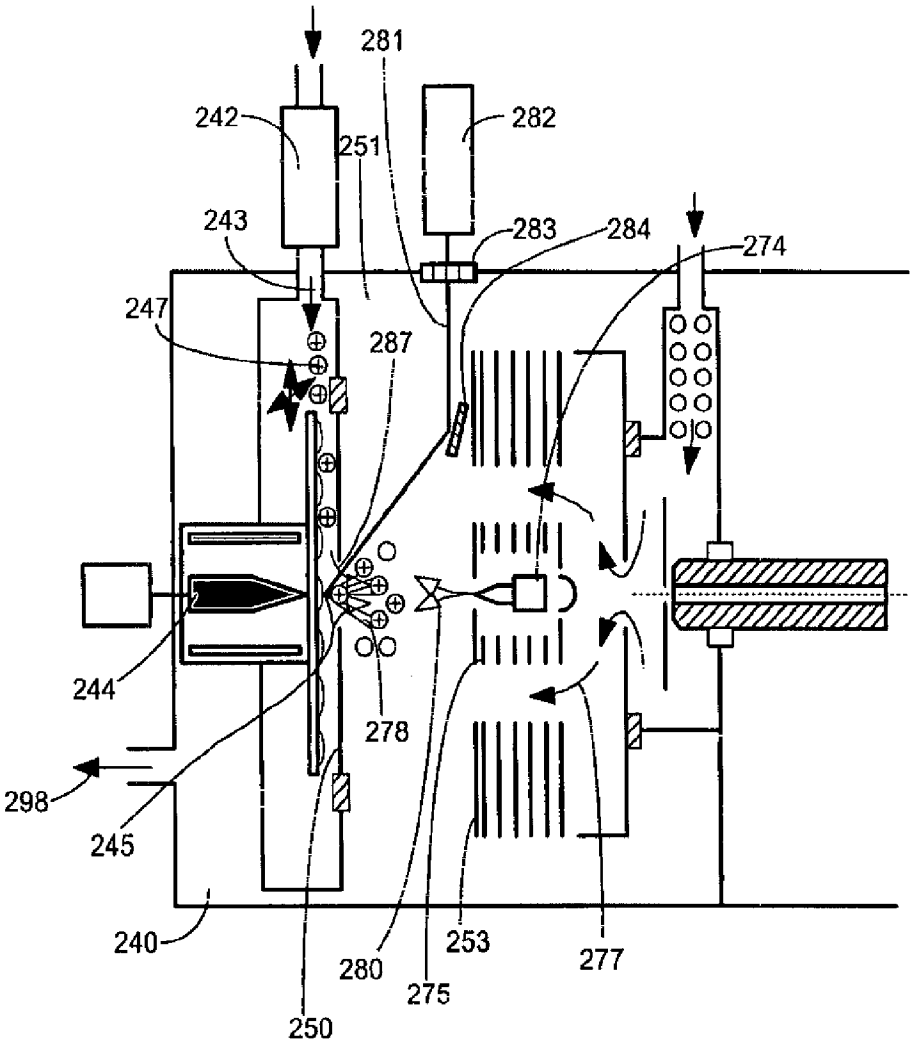
FIG. 10B is a diagram of the Laser Desorption Ionization source shown in FIG. 10A during the operating step of laser firing and charge release from the sample surface.
Figure 10C:
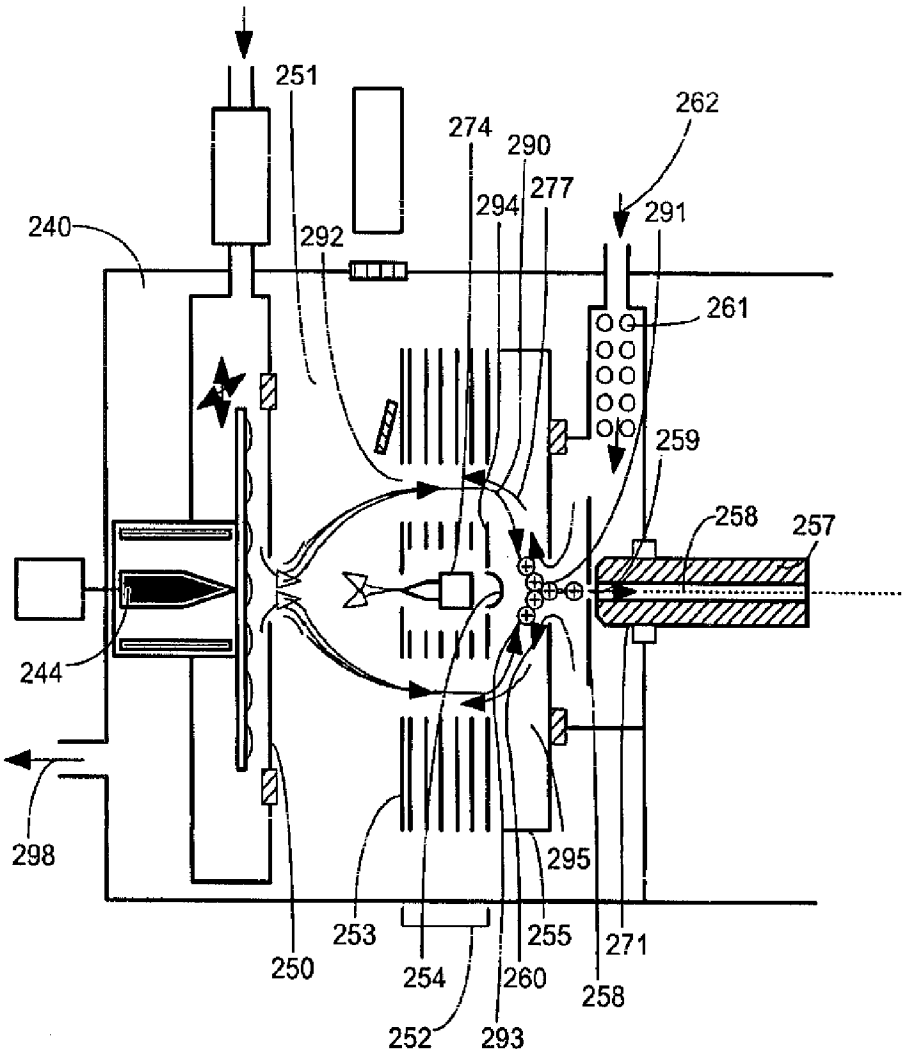
FIG. 10C is a diagram of the Laser Desorption Ionization source shown in FIG. 10A during the operating step of focusing the ion population produced into the orifice to vacuum.

In FIG. 10A, the relative voltages applied to charging electrode 244, target plate counter electrode 250, annular electrode 253 and charged droplet sprayer 274 are set to accumulate charge 246 on the surface of sample 245. Target plate gas flow 288 facilitates drying of charged droplets produced from charged droplet sprayer 274. Ions 248 generated from the evaporating charged droplets are directed toward sample 245 by the electric field applied in region 251. Charged species 247 entrained in target plate gas flow 243 are also directed toward the surface of sample 245 by the applied electric field. When sufficient charge has been accumulated on the surface of sample 245, laser pulse 281 is fired at sample 245 from laser 282 through lens 283 and reflected off mirror 284 as shown in FIG. 10B. As described for alternative embodiments above, relative voltages applied to electrodes 244, 250 and 253 and charged droplet sprayer 274 are changed just before, concurrent with or just after laser pulse 281 is fired to facilitate the release of charged species from sample 245. The timing of the voltage change relative the laser pulse event is optimized to maximize sample ionization efficiency. In the example shown, the voltage applied to electrode 253 remains constant during the sample charging, ion desorption and ion focusing steps. Nebulization gas flow 280 from charged droplet sprayer 274 and target plate gas flow 280 remains on during the sample charging, ion desorption and extraction and ion focusing steps providing a gas phase stagnation and mixing region in region 251 during each operating step. This mixing region facilitates gas phase ionization of desorbed neutral sample molecules by ions 247 entrained in target plate gas flow 288 during the desorption, extraction and ion focusing steps. Following a short delay after laser pulse 281 to allow desorbed ions and neutral species to move into region 251, the relative voltages applied to electrodes 244 and 250 and charged droplet sprayer 274 are changed to optimize ion transmission and focusing into bore 258 of capillary 257 through annulus 292 of annular electrode assembly 252 as illustrated in FIG. 10C.

Countercurrent drying gas 262 traverses gas heater 261 and flows through the center aperture of endplate electrode 255. Heated drying gas flow 260 is directed along endplate electrode 255 and through annulus 292 of annular electrode assembly 252. Heated countercurrent gas flow 260 becoming gas flow 277, moves in the opposite direction to ion movement through annulus 292 of annular electrode assembly 252 as ions are directed from region 251 to capillary bore entrance 259 as shown in FIG. 10C. Heated countercurrent gas flows 260 and 277 sweep any neutral contamination species away from annulus 292 of annular electrode assembly 252 preventing neutral contamination species from entering vacuum through capillary bore 258. Voltages are applied to the electrodes in electrode assembly 252 to focus and direct ions from region 251 to region 295 and into capillary bore entrance 259. Voltages applied to electrodes 294, 254, 255, 258 and capillary entrance electrode 271 are set to direct desorbed and gas phase generated ions 290 leaving electrode assembly annulus 292 through the center opening in endplate electrode 255 and focus ions 291 into capillary bore entrance 259 as shown in FIG. 10C. Annular electrode assembly 252 decouples ion formation region 251 from the capillary entrance region allowing the performance in both regions to be optimized independently Gas flows and gas temperatures, surface charging, ionization efficiency and the transport of ions into annular lens assembly 252 can be optimized in region 251. Ion focusing into capillary bore 258 in region 291 is decoupled from variable settings and step sequences occurring in region 251 allowing optimization of ion transport and focusing separate from performance optimization in region 251. Optimization of variables in focusing region 295 increases sensitivity of mass to charge analysis by increasing the efficiency of ion transport into capillary bore 258. Desorbed or gas phase generated ions entering capillary bore 258 pass into vacuum, pass through skimmer 297 and ion guide 266 and are analyzed in mass to charge analyzer and detector 267. Target gas flow 243, pneumatic nebulizer gas flow 280 and countercurrent gas flow 260 and 277 exit laser desorption ion source at gas outlet 298. Laser desorption ion source 240 may be operated at near atmospheric pressure. Alternatively laser desorption ion source 240 can be operated at pressures above one atmosphere to prevent outside contamination from backstreaming into the ion source chamber or at pressures below one atmosphere to accommodate negative pressure venting systems.

Figure 11:
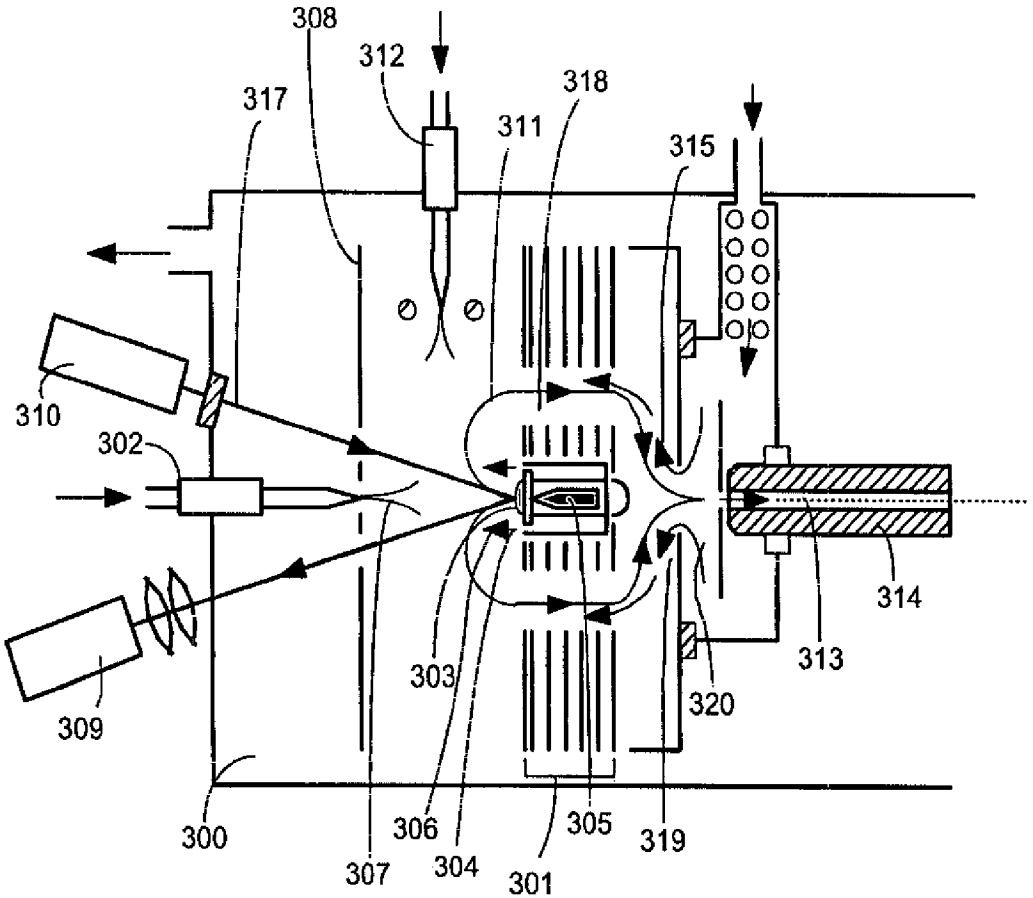
FIG. 11 is a diagram of an atmospheric Laser Desorption Ionization source comprising surface charging, a reversing annular ion focusing lens and surface imaging.

An alternative embodiment of the invention is diagrammed in FIG. 11 where combination Electrospray and laser desorption ion source 300 comprises annular electrode assembly 301. Charged droplet sprayer 302 with or without pneumatic nebulization generates charged species that are directed to the surface of sample 303 during the charge accumulation step. Sample is desorbed and ionized by laser pulse 317 fired from laser 310. The ions generated are directed into and through annular electrode assembly 301 by applying the appropriate voltages to back electrode 308, charged droplet sprayer 302, charging electrode 305 and annular electrode assembly 301. Ions exiting annular electrode assembly 301 are focused into bore 313 of capillary 314 moving against countercurrent drying gas 315. Optical imager 309 can be used to image the surface of sample 303. Based on this image, the position of laser pulse 317 and the tip of charging electrode 305 can be adjusted to provide optimal performance. Alternatively, sample ions can be generated from charged droplet sprayer 302. Target plate gas flow 307 aids in drying charged droples 307 produced by charged droplet sprayer 302. Ions generated from the evaporating charged droplets produced by charged droplet sprayer 302 are directed and focused into annulus 318 of annular electrode assembly 301. The charged droplet spray generated ions are directed through annulus 318 and focused into bore 313 of capillary 314. Alternatively, charged droplet sprayer 312 positioned orthogonal to target plate 304 can generate ions for charging sample 303 prior to laser desorption or can generate sample ions directly for mass to charged analysis. Annular lens assembly 301 configured in multiple ionization type ion source 300 decouples the ion production region from the ion focusing region into bore 313 of capillary 314 allowing decoupled optimization of each region and reducing mass spectrum noise from neutral contamination components entering vacuum. The sensitivity of mass to charged analysis is increased by the improved focusing of ions passing though regions 319 and 320 into capillary bore 313. Laser desorption of sample 304 and Electrospray ionization of a sample solution can occur simultaneously or independently in ion source 300. Running Electrospray simultaneously with laser desorption ionization allows gas phase ion-molecules reactions or the addition of known internal calibration peaks during mass spectrum acquisition.

The charging of a sample surface prior to conducting laser desorption can improve the efficiency of ion production in vacuum. Time-Of-Flight mass to charge analysis of ions generated from laser desorption or matrix assisted laser desorption in vacuum is well known in the art. Charging of sample surfaces prior to laser desorption can reduce mass measurement accuracies and resolving power in conventional MALDI TOF mass to charge analysis. When the steps of ion desorption and acceleration into the TOF flight tube are coupled, the kinetic energy of the desorbed ion species can effect the ion flight time. Charging of the ion surface can change the desorbed ion energy from laser shot to laser shot modifying the flight time of the desorbed ion species. Time delay acceleration of ions into the TOF pulsing region after a laser pulse can reduce the effects of initial ion energy spread and neutral gas interference but cannot compensate entirely for shot to shot differences in surface charging. Charging of a sample prior to a laser pulse in vacuum can be used in TOF mass to charge analysis if the laser desorption step and subsequent acceleration of ions into the TOF flight tube are decoupled. U.S. Pat. No. 6,683,301 B2, (U.S. Pat. No. '301) incorporated herein by reference, describes the apparatus and method for decoupling the steps of laser desorption of a sample in vacuum and subsequent pulsing of the ions generated into a TOF flight tube for mass to charged analysis. As described in U.S. Pat. No. '301, ions generated in the laser desorption step are directed to and trapped above a surface in near field potential wells formed by a high frequency electric field. The trapped ion population is subsequently accelerated into the TOF flight tube. Charging of the sample surface prior to the laser desorption step can be incorporated into such an apparatus and method to improve ionization efficiency or to conduct ion molecule reactions prior to laser desorption as diagrammed in FIGS. 12A through 12D.

Figure 12A:
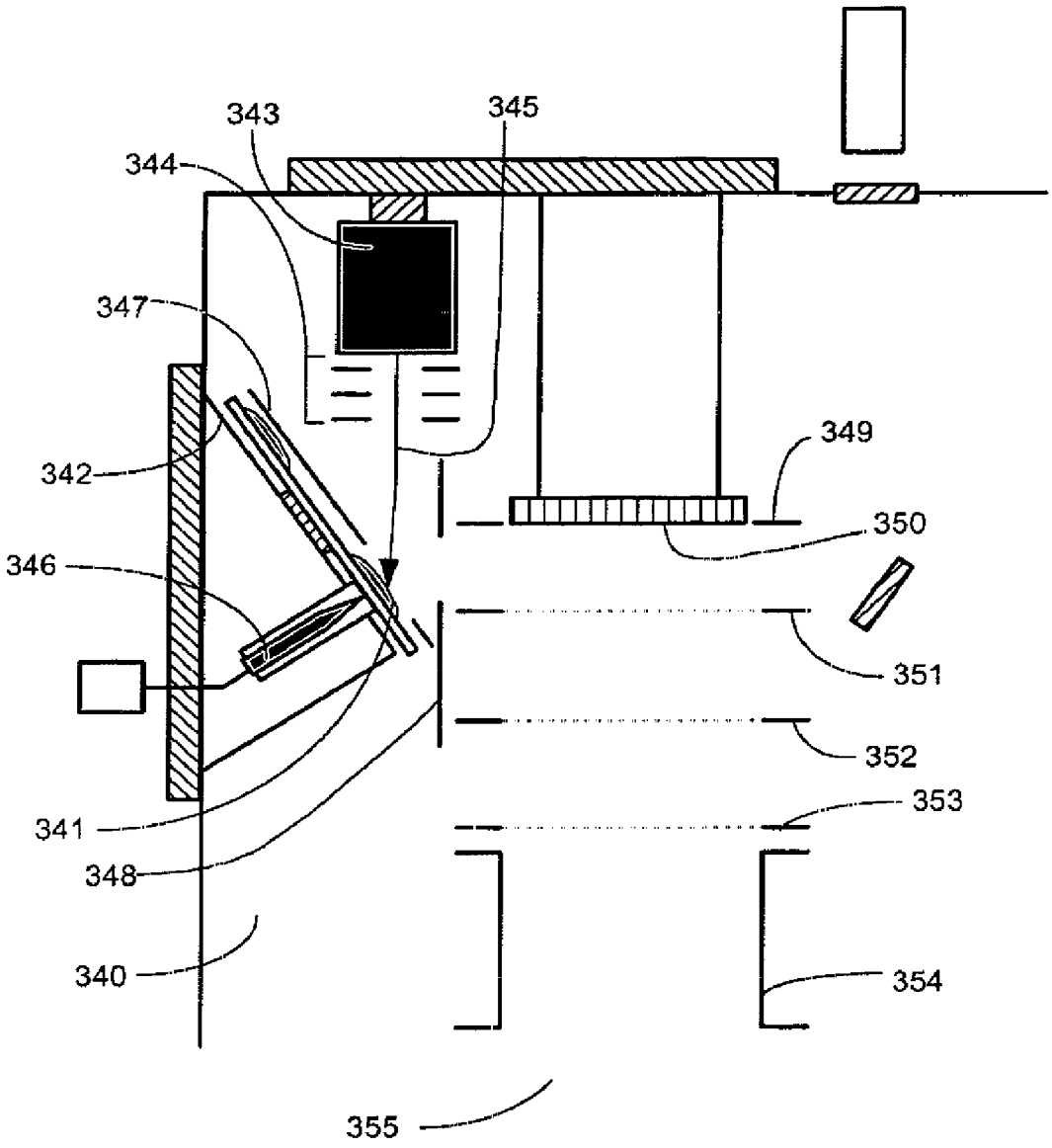
FIG. 12A is a diagram of a vacuum Laser Desorption Ionization source configured with surface charging and a near surface potential trap configured in the pulsing region of a Time-Of-Flight mass spectrometer during surface charging operation.
Figure 12B:
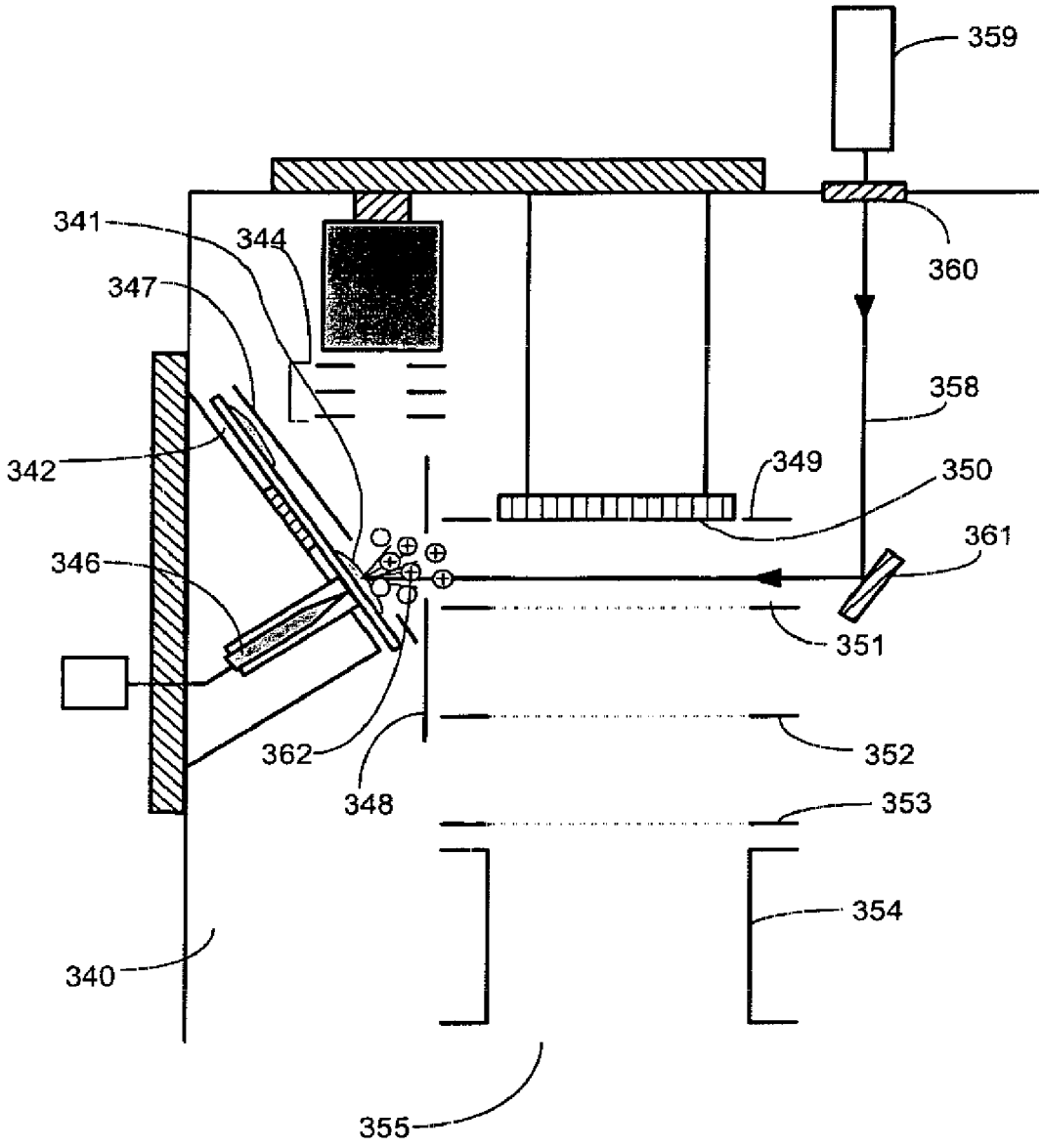
FIG. 12B is a diagram of the vacuum Laser Desorption Ionization source shown in FIG. 12A during the operating step of laser firing and charge release from the sample surface.
Figure 12C:
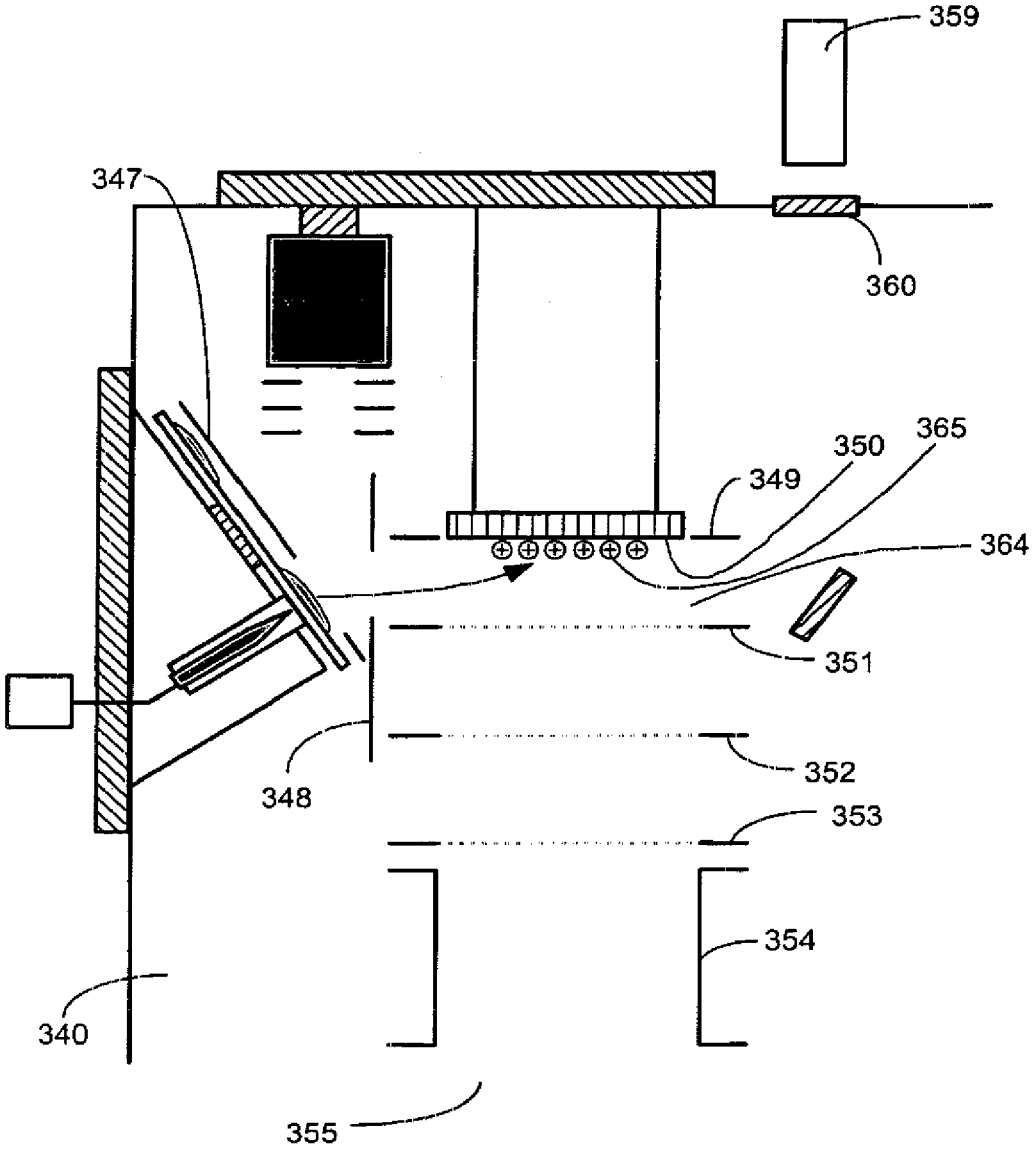
FIG. 12C is a diagram of the vacuum Laser Desorption Ionization source shown in FIG. 12A during the operating step of trapping the ion population produced on the dynamic field trapping surface.
Figure 12D:
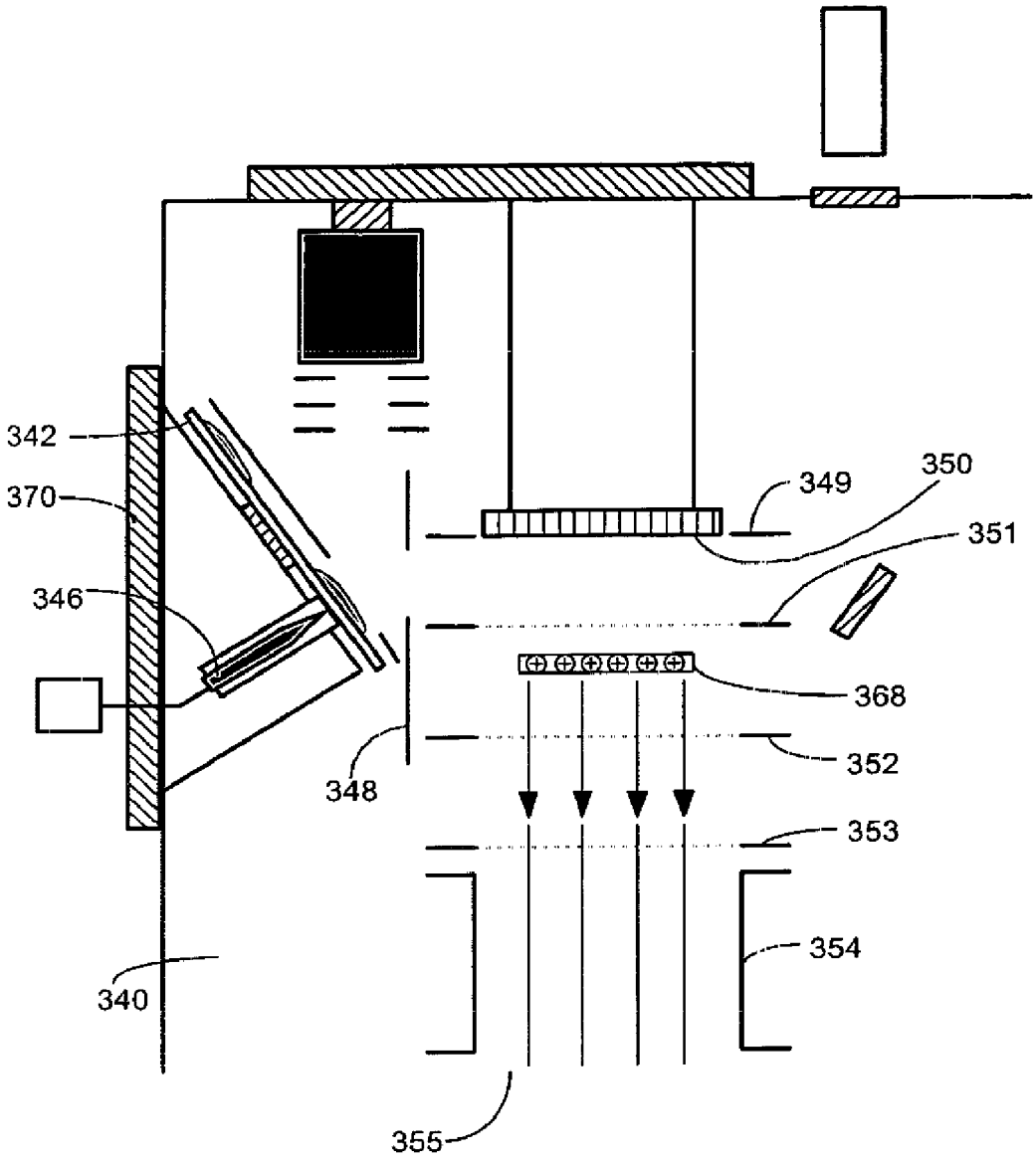
FIG. 12D is a diagram of the vacuum Laser Desorption Ionization source shown in FIG. 12A during the operating step of pulsing the ion population produced into the Time-OF-Flight mass spectrometer flight tube.

An alternative embodiment of the invention is diagrammed in FIGS. 12A through 12D mounted in vacuum chamber 340. FIG. 12A illustrates the step of charge accumulation on the surface of sample 341 positioned on dielectric target plate 342. Charge is accumulated on the surface of sample 341 by directing ion beam 345 to the surface of sample 341 by applying the appropriate focusing and accelerating potentials to charging electrode 346, focusing electrode set 344, target plate counter electrode 347, TOF pulsing region entrance electrode 348, trapping surface 350, trapping electrode 349, and ion accelerating electrodes 351, 352 and 353. Ion beam 345 is generated by ion source 343 operating in vacuum. Ion source 343 may be an electron bombardment, chemical ionization, glow discharge, or other vacuum ion source known in the art. When the maximum charging of the surface of sample 341 has been achieved, laser pulse 358 is directed to sample 341 from laser 359 through optical lens 360 and reflected off mirror 361 as shown in FIG. 12B. The voltages applied to electrodes 346, 347, 344, 348, 349, 351 and trapping surface 350 are changed to direct the population of desorbed ion species 362 toward trapping surface 350 and trap desorbed ions 362 above trapping surface 350 as shown in FIGS. 12B and 12C. As described in U.S. Pat. No. '301, the reduction of kinetic energies of ions 365 trapped above dynamic electric field trapping surface 350 may be achieved by ion collisions with neutral background gas or by laser cooling of ions. Sufficient neutral background gas may be locally present in TOF pulsing region 364 to reduce trapped ion kinetic energy or neutral gas may be added to TOF pulsing region 364 through a pulsed gas valve. Alternatively, laser cooling may be applied to reduce the trapped ion kinetic energy. Redirected laser pulse 358 aimed at or along trapping surface 350 may be used for laser cooling of trapped ion 365 kinetic energy although a reduction in power may be required compared with laser desorption pulse 358. Laser pulse or beam 358 can be redirected toward trapping surface 350 by moving the angle of mirror 361 and the laser power can be reduced by defocusing laser pulse 358 using lens 360 or reducing the power output of laser 359. After the kinetic energy spread of trapped ions 365 has been reduced, voltages are changed on trapping surface 350, electrode 349 and grid electrodes 351 and 352 to accelerate or push-pull trapped ions 365 into TOF flight tube 355 through grid electrodes 351, 352 and 353. Accelerated ions 368 may be steered in TOF flight tube 355 using steering electrode set 354. Ion 368 are accelerated from trapping surface 350 into TOF flight tube 355 to maximize TOF performance by changing voltages applied to trapping surface 350 and electrodes 349, 351 and 352 as more fully described in U.S. Pat. No. '301. In the embodiment shown in FIGS. 12A through 12D grid electrode 353 forms part of the TOF flight tube and the voltage applied to electrode 353 and remains constant during the sample charging, laser desorption, ion trapping and ion acceleration steps described above.

Ions accelerated from trapping surface 350 into TOF flight tube 355 are mass to charge analyzed and detected. TOF flight tube may comprise a linear flight path or be configured with one or more ion reflectors to increase mass to charge analysis resolving power. Multiple sample charging and laser desorption steps may be conducted for each step of accelerating ions into TOF Flight tube 355. This will increase analytical speed if the trapped ion kinetic energy cooling step is the longest step in the ion charging, desorption, extraction and analysis sequence. Target plate 342 can be rotated or translated to move different samples into position or to optimize the sample position relative to the tip of charging electrode 346 and laser pulse 358. Optical imaging of the sample may be performed to direct adjustment of the sample surface for optimal performance Target plates are removed and replaced by the changing of flange 370. Flange 370 may be replaced with an automatic target plate loading and pumpdown system that allows removal and loading of target plate 342 without venting TOF flight tube vacuum chamber 340. Unlike conventional vacuum laser desorption, the flatness tolerance, dimensional reproducibility and material selection of target plate 342 are relaxed in the embodiment of the invention shown. This reduces cost and improves selection of materials that may be more compatible with specific samples.

Sample charging prior to laser desorption can be configured with ion guides in atmospheric pressure, intermediate pressure and vacuum laser desorption ion sources. U.S. Pat. No. 6,707,037 B2 (U.S. Pat. No. '037) incorporated herein by reference describes laser desorption ion sources comprising multipole ion guides configured in atmospheric pressure, intermediate pressure and vacuum regions. The step of charge accumulation on or near the sample surface prior to applying a laser desorption pulse can be added to embodiments described in U.S. Pat. No. '037. Separately generated reagent ions can be introduced axially through the ends of multipole ion guides or radially through the gaps between rods in multipole ion guides prior to applying a laser desorption pulse to a sample. The added reagent ion charge can accumulate on the sample surface or be trapped in the multipole ion guides to enhance ion-molecule reaction gas phase ionization of neutral desorbed components through ion-molecule reactions. Reagent ions of the opposite polarity can be added to the multipole ion guide volume to promote gas phase ion-ion reactions. For desorbed positive multiply charged ions, the addition of an electron to multiply charged positive polarity ions through ion-ion gas phase reactions may lead to positive ion fragmentation through electron capture or electron transfer fragmentation mechanisms ions generated through laser desorption or gas phase ion-molecule reactions are directed through the ion guide to a mass to charge analyzer for mass to charge analysis employing methods and apparatus as described in U.S. Pat. No. '037. Other ion guides such as sequential disk RF ion guides or other ion guide types known in the art may be used as an alternative to the multipole ion guide embodiments.

Ions generated in the laser desorption ion sources described above alternatively be analyzed using ion mobility analyzers or combinations of ion mobility analyzers with mass spectrometers. Although the present invention has been described in accordance with the embodiments shown, one of ordinary skill in the art will recognize that there could be variations to the embodiments, and those variations would be within the spirit and scope of the present invention.

Configuration and operation of the embodiments of laser desorption ion source as described above provide performance improvements as described above and as listed below: a) By precisely timing and positioning the laser desorption process to coincide with a potential pulse to the sample, the sample can be desorbed and ionized from the target in optimum electric fields and flow leading to efficient extraction of ions from the target, and by subsequently cycling the electric potential to more appropriate focusing fields the ions can be more efficiently focused and transmitted to and through the conductance opening to lower pressures b) By charging the sample surface with reagent ions or electrons prior to the laser desorption process, the ionization process can occur more efficiently. c) By charging the sample with selected reagent ions the selectivity of ionization process can be improved and analyte can be chemically labeled or tagged. d) By charging the sample with selected reagent ions at a predetermined collection point and matching the collection point with the laser pulse, a specific point on a sample (e.g. stained spot of 2D gel or organelle in tissue sample) can be selectively desorbed and ionized e) By laser desorbing and ionizing samples at higher pressures, such as at atmospheric pressure, the motion of the gas-phase ions is more controllable than performing desorption and ionization at lower pressures because the ions tend to follow the electric field in absence of flow or other forces. The addition of flow as a ion focusing parameter gives the device more degrees of freedom to control motion and enhance focusing (e.g. counterflow in focusing field can enhance focusing). f) By introducing sample from a liquid stream such as capillary electrophoresis or liquid chromatography, the device can operate as a continuous interface for LC/MS or CE/MS. g) By controlling the extraction and focusing fields in a time-sequence to optimize both processes, the alignment and position of the sample relative to the conductance opening is less critical. h) By using optical alignment instead of positional alignment of sample and conductance opening, the loading of the sample into the source becomes much easier and the nature of the sample (e.g. direct tissue samples, direct 2D gels or western blots, flowing sample) can be far more diverse than conventional MALDI spots.

What is claimed is:

1. An apparatus for producing gas phase ions from a sample substance comprising:

(a) a sample holder for holding at least one sample, wherein said sample holder comprises a dielectric surface;

(b) at least one ion source for generating gas phase reagent ions and/or charged droplets comprising reagent ions, (c) at least one charging electrode located proximal to said dielectric surface for directing said gas phase reagent ions and/or charged droplets onto said at least one sample;

(d) at least one voltage applied to said at least one charging electrode, respectively;

(e) a pulsed light source for generating light pulses directed at said at least one sample to desorb constituents of said at least one sample and said reagent ions from said at least one sample to form gas phase sample related ions.

2. The apparatus of claim 1, further comprising: (a) ion optics comprising electrodes with voltages applied to direct said gas phase reagent ions and/or charged droplets onto said sample; (b) means for changing said voltages applied to said electrodes and said at least one charging electrode to extract a portion of said sample ions from said sample holder into the gas phase to form gas phase sample related ions.

3. The apparatus of claim 1, further comprising: means for directing at least a portion of said reagent ions and/or charged droplets to mix with said desorbed sample constituents resulting in ionization of at least a portion of said desorbed sample constituents in the gas phase to form gas phase sample related ions.

4. The apparatus of claim 1, further comprising: (a) ion optics comprising electrodes with voltages applied to direct said gas phase reagent ions and/or charged droplets onto said sample;

(b) means for changing said voltages applied to said electrodes and said at least one charging electrode to extract a portion of said sample ions from said sample holder into the gas phase to form gas phase sample related ions; and (c) means for directing at least a portion of said reagent ions and/or charged droplets to mix with said desorbed sample constituents resulting in ionization of at least a portion of said desorbed sample constituents in the gas phase to form gas phase sample related ions.

5. The apparatus of any of claim 1, 2, 3 or 4, wherein said dielectric surface comprises one surface of a target plate composed of a dielectric material.

6. The apparatus of claim 5, wherein said target plate is movable.

7. The apparatus of claim 5, wherein said target plate comprises a thin dielectric sheet.

8. The apparatus of claim 5, wherein said dielectric material comprises at least one bore, and said at least one sample is held within said at least one bore.

9. The apparatus of any of claim 1, 2, 3 or 4, wherein said dielectric surface comprises a moving dielectric belt.

10. The apparatus of any of claim 1, 2, 3 or 4, wherein said dielectric surface comprises the end of at least one fiber optic bundle, and wherein said light pulses are directed at said at least one sample through said at least one fiber optic bundle.

11. The apparatus of any of claim 1, 2, 3 or 4, wherein said dielectric surface comprises a surface of a dielectric material, wherein said at least one charging electrode is encased within said dielectric material.

12. The apparatus of claim 11, further comprising at least one shielding electrode proximal to said at least one charging electrode, wherein said at least one shielding electrode is encased within said dielectric material.

13. The apparatus of claim 12, wherein said at least one shielding electrode is encased within said dielectric material.

14. The apparatus of any of claim 1, 2, 3 or 4, further comprising at least one shielding electrode proximal to said at least one charging electrode.

15. The apparatus of claim 14, further comprising a dielectric block, said dielectric block comprising at least one liquid sample conduit for delivering said at least one sample to said dielectric surface, and wherein said at least one charging electrode is encased within said dielectric block.

16. The apparatus of any of claim 1, 2, 3 or 4, further comprising a mass to charge analyzer for analyzing said gas phase sample related ions.

17. The apparatus of claim 16, wherein said mass to charge analyzer is one of a group that includes a quadrupole, triple quadrupole, three-dimensional ion trap, linear ion trap, Time-of-Flight, magnetic sector, Fourier Transform Ion-Cyclotron Resonance, and Orbitrap mass analyzer.

18. The apparatus of any of claim 1, 2, 3 or 4, wherein said sample holder is positioned in approximately atmospheric pressure.

19. The apparatus of any of claim 1, 2, 3 or 4, wherein said sample holder is positioned in vacuum pressure below $10^{-4}$ Torr.

20. The apparatus of any of claim 1, 2, 3 or 4, wherein said sample holder is positioned in intermediate vacuum pressure ranging from 10 Torr to $1\times10^{-}4$ Torr.

* * * * *

UNITED STATES PATENT AND TRADEMARK OFFICE

CERTIFICATE OF CORRECTION

PATENT NO. : 7,816,646 B1
APPLICATION NO. : 12/123669
DATED : October 19, 2010
INVENTOR(S) : Ross C. Willoughby It is certified that error appears in the above-identified patent and that said Letters Patent is hereby corrected as shown below:

Column 24,
Line 12, delete "$1x10^{-}4$" and insert --$1x10^{-4}$--

Signed and Sealed this
Fourth Day of January, 2011

David J. Kappos

David J. Kappos
*Director of the United States Patent and Trademark Office*